US008224208B2

(12) United States Patent
Shimba

(10) Patent No.: US 8,224,208 B2
(45) Date of Patent: Jul. 17, 2012

(54) IMAGE FORMING APPARATUS

(75) Inventor: Takeshi Shimba, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 301 days.

(21) Appl. No.: 12/729,988

(22) Filed: Mar. 23, 2010

(65) Prior Publication Data

US 2010/0247121 A1 Sep. 30, 2010

(30) Foreign Application Priority Data

Mar. 26, 2009 (JP) ..... 2009-076769
Dec. 14, 2009 (JP) ..... 2009-283463

(51) Int. Cl.
*G03G 15/16* (2006.01)

(52) U.S. Cl. ..... 399/227; 399/43; 399/66; 399/110; 399/297; 399/302

(58) Field of Classification Search ..... 399/43, 399/66, 110, 111, 227, 297, 301, 302
See application file for complete search history.

(56) References Cited

U.S. PATENT DOCUMENTS 6,044,234 A * 3/2000 Yoshizawa ..... 399/49
6,094,557 A * 7/2000 Shinohara ..... 399/302
6,308,019 B1 * 10/2001 Miyashiro et al. ..... 399/66
7,286,789 B2 10/2007 Umezawa
7,366,430 B2 * 4/2008 Shishikura et al. ..... 399/9

FOREIGN PATENT DOCUMENTS

JP 06289685 A * 10/1994
JP 10-254210 A 9/1998
JP 2000056591 A * 2/2000
JP 2000-066475 A 3/2000
JP 2001183882 A * 7/2001
JP 2006-145595 A 6/2006

* cited by examiner

*Primary Examiner* — David Gray
*Assistant Examiner* — Francis Gray
(74) *Attorney, Agent, or Firm* — Canon U.S.A., Inc. IP Division

(57) ABSTRACT

An image forming apparatus is configured to control the timing to switch a development unit by a development rotary after forming an image, based on the size of the image to be formed. Accordingly, if the switching of the development unit is completed within a time period corresponding to a trailing edge margin of an image area, a subsequent color image can be formed without idling an intermediate transfer member, so that the image forming apparatus can suppress or reduce degradation of the throughput.

8 Claims, 12 Drawing Sheets

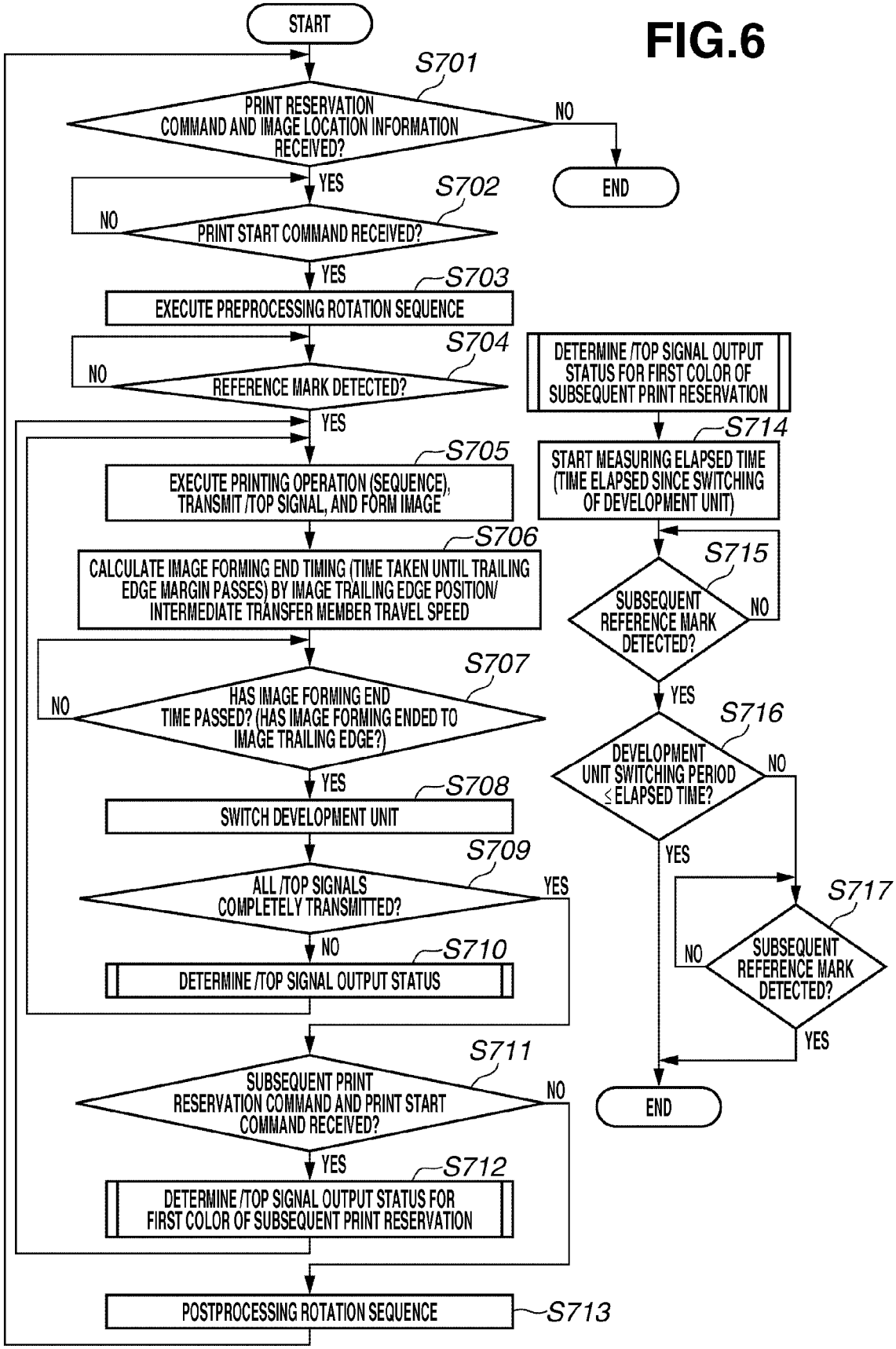
FIG.6
START
S701
PRINT RESERVATION COMMAND AND IMAGE LOCATION INFORMATION RECEIVED?
NO
END
YES
S702
NO
PRINT START COMMAND RECEIVED?
YES
S703
EXECUTE PREPROCESSING ROTATION SEQUENCE
S704
NO
REFERENCE MARK DETECTED?
YES
S705
EXECUTE PRINTING OPERATION (SEQUENCE), TRANSMIT /TOP SIGNAL, AND FORM IMAGE
S706
CALCULATE IMAGE FORMING END TIMING (TIME TAKEN UNTIL TRAILING EDGE MARGIN PASSES) BY IMAGE TRAILING EDGE POSITION/ INTERMEDIATE TRANSFER MEMBER TRAVEL SPEED
S707
NO
HAS IMAGE FORMING END TIME PASSED? (HAS IMAGE FORMING ENDED TO IMAGE TRAILING EDGE?)
YES
S708
SWITCH DEVELOPMENT UNIT
S709
ALL /TOP SIGNALS COMPLETELY TRANSMITTED?
YES
NO
S710
DETERMINE /TOP SIGNAL OUTPUT STATUS
S711
SUBSEQUENT PRINT RESERVATION COMMAND AND PRINT START COMMAND RECEIVED?
NO
YES
S712
DETERMINE /TOP SIGNAL OUTPUT STATUS FOR FIRST COLOR OF SUBSEQUENT PRINT RESERVATION
POSTPROCESSING ROTATION SEQUENCE
S713
DETERMINE /TOP SIGNAL OUTPUT STATUS FOR FIRST COLOR OF SUBSEQUENT PRINT RESERVATION
S714
START MEASURING ELAPSED TIME (TIME ELAPSED SINCE SWITCHING OF DEVELOPMENT UNIT)
S715
SUBSEQUENT REFERENCE MARK DETECTED?
NO
YES
S716
DEVELOPMENT UNIT SWITCHING PERIOD ≤ ELAPSED TIME?
NO
YES
S717
NO
SUBSEQUENT REFERENCE MARK DETECTED?
YES
END

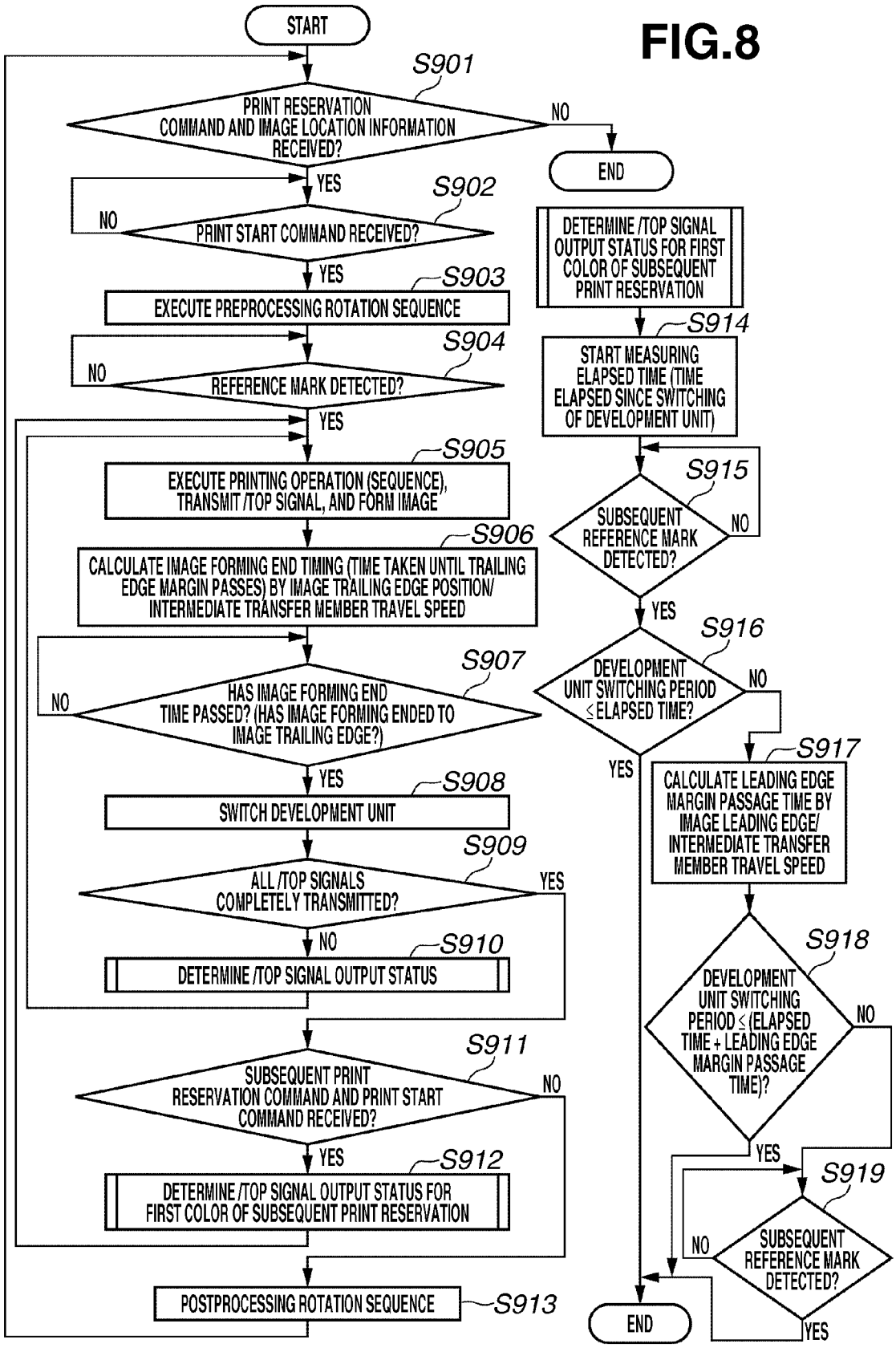
FIG.8
START
S901
PRINT RESERVATION COMMAND AND IMAGE LOCATION INFORMATION RECEIVED?
NO
END
YES
S902
NO
PRINT START COMMAND RECEIVED?
YES
S903
EXECUTE PREPROCESSING ROTATION SEQUENCE
S904
NO
REFERENCE MARK DETECTED?
YES
S905
EXECUTE PRINTING OPERATION (SEQUENCE), TRANSMIT /TOP SIGNAL, AND FORM IMAGE
S906
CALCULATE IMAGE FORMING END TIMING (TIME TAKEN UNTIL TRAILING EDGE MARGIN PASSES) BY IMAGE TRAILING EDGE POSITION/ INTERMEDIATE TRANSFER MEMBER TRAVEL SPEED
S907
NO
HAS IMAGE FORMING END TIME PASSED? (HAS IMAGE FORMING ENDED TO IMAGE TRAILING EDGE?)
YES
S908
SWITCH DEVELOPMENT UNIT
S909
ALL /TOP SIGNALS COMPLETELY TRANSMITTED?
YES
NO
S910
DETERMINE /TOP SIGNAL OUTPUT STATUS
S911
SUBSEQUENT PRINT RESERVATION COMMAND AND PRINT START COMMAND RECEIVED?
NO
YES
S912
DETERMINE /TOP SIGNAL OUTPUT STATUS FOR FIRST COLOR OF SUBSEQUENT PRINT RESERVATION
POSTPROCESSING ROTATION SEQUENCE
S913
DETERMINE /TOP SIGNAL OUTPUT STATUS FOR FIRST COLOR OF SUBSEQUENT PRINT RESERVATION
S914
START MEASURING ELAPSED TIME (TIME ELAPSED SINCE SWITCHING OF DEVELOPMENT UNIT)
S915
SUBSEQUENT REFERENCE MARK DETECTED?
NO
YES
S916
DEVELOPMENT UNIT SWITCHING PERIOD ≤ ELAPSED TIME?
NO
YES
S917
CALCULATE LEADING EDGE MARGIN PASSAGE TIME BY IMAGE LEADING EDGE/ INTERMEDIATE TRANSFER MEMBER TRAVEL SPEED
S918
DEVELOPMENT UNIT SWITCHING PERIOD ≤ (ELAPSED TIME + LEADING EDGE MARGIN PASSAGE TIME)?
NO
YES
S919
NO
SUBSEQUENT REFERENCE MARK DETECTED?
YES
END

IMAGE FORMING APPARATUS

BACKGROUND OF THE INVENTION

1. Field of the Invention

The present invention relates to a color image forming apparatus, such as an electrophotographic type or electrostatic recording type copying machine or printer.

2. Description of the Related Art

In a rotary type image forming apparatus, a development rotary rotates for every rotation of an intermediate transfer member. Furthermore, visible images of yellow, magenta, cyan, and black are serially formed on a photosensitive drum by using a yellow development unit, a magenta development unit, a cyan development unit, and a black development unit in this order.

In addition, the formed visible images are transferred during four rotations of the intermediate transfer member. In this manner, color images are formed on the intermediate transfer member. More specifically, color images can be formed by transferring each toner at the same position of the intermediate transfer member.

Japanese Patent Application Laid-Open No. 2000-66475 discusses a method capable of forming each color visible image at the same position of an intermediate transfer member by detecting and using a reference mark provided on a periphery of the intermediate transfer member with an optical sensor, which outputs an image forming reference signal (hereinafter simply referred to as a "/TOP signal") as a signal indicating an image forming start position on the intermediate transfer member based on timing to detect the reference mark.

In the following description, /TOP signals of four colors of yellow, magenta, cyan, and black, based on the timing to detect a reference mark with the optical sensor, are defined as a "/TOP signal Y", a "/TOP signal M", a "/TOP signal C", and a "/TOP signal k", respectively.

Meanwhile, because the size of an image forming apparatus has recently been reduced, the peripheral length of an intermediate transfer member of a recent image forming apparatus has been short. In this case, the peripheral length of the intermediate transfer member is only slightly longer than the longitudinal size of a maximum-size sheet on which an image can be formed by such a recent image forming apparatus.

Under these circumstances, if the difference between the peripheral length of an intermediate transfer member and the paper size is small, switching of a current development unit to a subsequent development unit may not be completed before detecting a subsequent reference mark. In this case, a /TOP signal of a subsequent color is output after an idle running of the intermediate transfer member for one rotation.

FIG. 12 is a timing chart illustrating timing of control for idling an intermediate transfer member by one rotation. Referring to FIG. 12, a print reservation command for two pages is transmitted from a controller unit 201 to an engine control unit 202. After receiving a print start command 1 (timing 305) corresponding to a print reservation command for one page (timing 303), the engine control unit 202 starts preprocessing rotation sequence.

After the preprocessing rotation sequence is completed (timing 320), if a reference mark is detected (timing 330), a /TOP signal Y1 is output (timing 340) and an operation for printing a first page starts.

The controller unit 201, in synchronization with the output of the /TOP signal Y1 (timing 340), transmits image data of yellow to the engine control unit 202 (timings 350 and 351). Furthermore, the engine control unit 202 executes control for contacting a development unit and a photosensitive drum with each other according to a paper size designated in the print reservation command 1 (the timing 303). After that, the engine control unit 202 causes the development unit to separate from the photosensitive drum and switches the development unit from a development unit Y to a development unit M (timing 321).

When a reference mark is detected (timing 331), the development unit is currently being switched from the development unit Y to the development unit M. Accordingly, a /TOP signal (M1) cannot be transmitted at timing 341.

After the switching of the development unit is completed at timing 322, in synchronization with timing to detect a reference mark after one rotation of the intermediate transfer member (timing 332), a /TOP signal M1 is output (timing 342). After that, the development unit is switched (timings 323 and 325) for /TOP signals C and K1 (respectively output at timings 344 and 346) in a similar manner.

At timing to detect a reference mark during switching of the development unit (timings 333 and 335), the /TOP signals C1 and K1 (output at timings 343 and 345 respectively) are not transmitted.

After completing the switching of the development unit (timings 324 and 326), in synchronization with the detection of the reference mark by one rotation of the intermediate transfer member (timings 334 and 336), /TOP signals C1 and K1 are output (timings 344 and 346).

The controller unit 201 transmits M, C, and K image data of the first page to the engine control unit 202 (at timings 360 and 361, 370 and 371, and 380 and 381, respectively). After having completely transmitted all the image data of four colors, a print start command 2 is output (timing 306), which corresponds to a print reservation command 2 for a second page (output at timing 304).

After receiving the print start command 2 (timing 306) and after image forming K1 of the first page is completed (timing 381), the engine control unit 202 switches the development unit from the development unit K to the development unit Y (timing 327). At timing at which a reference mark is detected during switching of the development unit (timing 337), a /TOP signal Y2 is not transmitted (timing 347).

After having completed the switching of the development unit (timing 328), in synchronization with timing at which a reference mark is detected by one rotation of the intermediate transfer member (timing 338), a /TOP signal Y2 is output (timing 348). M, C, and K images are formed on subsequent pages in the same manner as forming the same on the first page.

If neither a print reservation command nor a print start command for a third page have not been received, the engine control unit 202 starts post processing of a printing operation (hereinafter simply referred to as "post processing rotation sequence") and ends the printing operation.

As described above, if timing to detect a reference mark comes during switching of a development unit, it becomes necessary to idle the intermediate transfer member by one rotation to delay the timing of transmitting a /TOP signal. Japanese Patent Application Laid-Open No. 2006-145595 discusses a method for preventing unnecessary idling of an intermediate transfer member by reducing the traveling speed of an intermediate transfer member to a speed lower than a usual traveling speed.

As described above, in the above-described conventional method, idling of an intermediate transfer member is prevented by reducing the speed thereof. However, in a small size image forming apparatus, it is difficult to change the traveling speed of the intermediate transfer member. Accordingly, if the development unit cannot be switched before detecting a reference mark, the idling of the intermediate transfer member becomes always necessary.

If the above-described control is executed, the throughput becomes low. Accordingly, it is desired by the market to improve the throughput.

SUMMARY OF THE INVENTION

The present invention is directed to a method for suppressing or reducing degradation of a throughput of an image forming apparatus by appropriately controlling timing to switch a development unit based on the size of each color image to be formed.

According to an aspect of the present invention, an image forming apparatus includes an image bearing member, a plurality of development units configured to form an image on the image bearing member, a development rotary configured to serially switch each of the plurality of development units to an image forming position at which an image is formed on the image bearing member, an intermediate transfer member on which the image formed on the image bearing member is transferred, and a control unit configured to give an instruction to start forming of the image if a mark that is a reference of starting forming of the image and is provided on the intermediate transfer member, is detected. In the image forming apparatus, the control unit is configured to compare a first time period, which is a time from start of switching of the development unit to detection of the mark, with a second time period, which is a of time taken for switching the development unit, and if the second time period is shorter than the first time period, configured to start switching to a subsequent development unit by moving the subsequent development unit to the image forming position after the image is completely formed by the development unit existing at the image forming position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

FIG. 6 is a flow chart illustrating an example of processing executed by a color image forming apparatus according to the first exemplary embodiment of the present invention.

FIG. 8 is a flow chart illustrating an example of processing executed by a color image forming apparatus according to the second exemplary embodiment of the present invention.

DESCRIPTION OF THE EMBODIMENTS

Various exemplary embodiments, features, and aspects of the invention will be described in detail below with reference to the drawings.

In the following description, each exemplary embodiment of the present invention does not limit the scope of the present invention. In addition, not all combinations of characteristic effects of each exemplary embodiment are necessary for implementing each exemplary embodiment.

In a first exemplary embodiment of the present invention, a position of a trailing edge of a sheet in a direction of conveyance of the sheet is calculated based on image location information. Thus, a margin on the trailing edge (hereinafter may be simply referred to as a "trailing edge margin") is determined. Timing of switching a development unit is changed based on the information about the sheet trailing edge position and the trailing edge margin of the sheet.

If the switching of the development unit can be completed before detecting a subsequent reference mark, the present exemplary embodiment executes image forming of a subsequent color without idling an intermediate transfer member.

Figure 1:
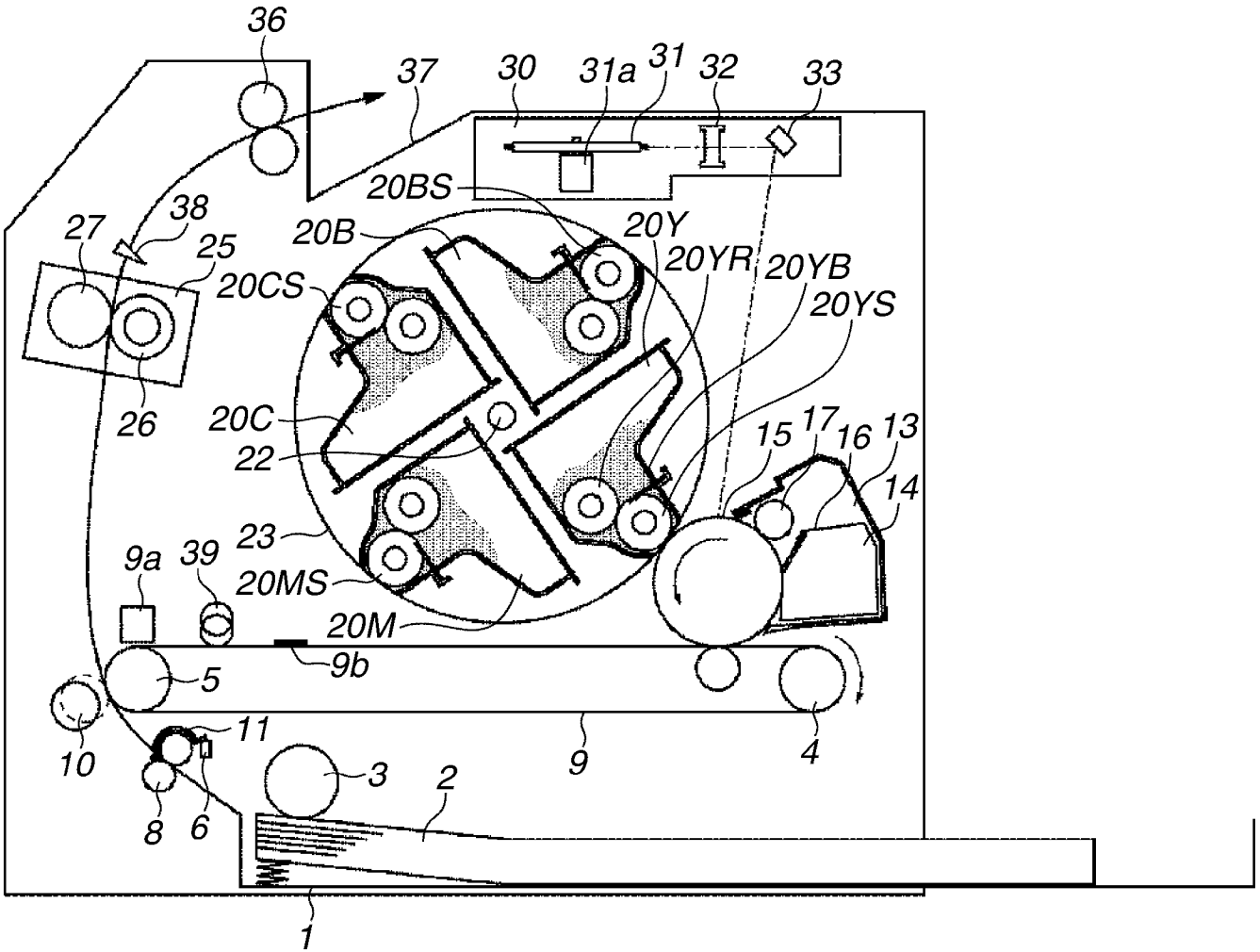
FIG. 1 illustrates an example of an outline configuration of a color image forming apparatus according to an exemplary embodiment of the present invention.

FIG. 1 illustrates an example of a configuration of the entire color image forming apparatus according to the present exemplary embodiment. Referring to FIG. 1, a yellow development unit 20Y, a magenta development unit 20M, a cyan development unit 20C, and a black development unit 20Bk are supported by a development rotary 23, which is a rotatable development unit.

The development rotary 23 can rotate and is capable of switching the development unit from one color development unit to another color development unit, of development units for a plurality of colors. The development rotary 23 can contact a photosensitive drum (image bearing member) 15. By contacting the photosensitive drum 15, the development rotary 23 serially forms and develops images on the photosensitive drum 15. A position of the development will hereafter be referred to as an "image forming position".

In addition, the development rotary 23 serially transfers the developed images onto an intermediate transfer belt 9, which is an example of an intermediate transfer member. The development rotary 23 forms color images by multiple transfer.

The formed color images are transferred on a transfer material 2, which has been fed from a paper feed unit 1. Thus, the color images are formed on the transfer material 2. The transfer material 2 having the color images formed thereon is conveyed to and fixed by a fixing unit 25. Then, the transfer material 2 having the color images fixed thereon is discharged by a paper discharge roller 36 to a paper discharge portion 37, which is provided on a top portion of the color image forming apparatus.

Each of the yellow development unit 20Y, the magenta development unit 20M, the cyan development unit 20C, and the black development unit 20Bk, which can rotate, is detachably mounted on a body of the image forming apparatus.

Now, an exemplary configuration and operation of each unit of the color image forming apparatus will be described in detail below.

A drum unit 13 includes the photosensitive drum 15, which is an image bearing member having a shape of a drum, and a cleaner container 14, which is a cleaning device that can also serve as a holder for the photosensitive drum 15. The cleaner container 14 and the photosensitive drum 15 are integrally mounted inside the drum unit 13. The drum unit 13 is detachably mounted on the image forming apparatus body. If the life of the photosensitive drum 15 expires, the drum unit 13 can be easily exchanged as a whole.

On the periphery of the photosensitive drum 15, a cleaner blade 16 and a electro conductive roller 17, which is a primary charging unit are provided. The photosensitive drum 15 rotates in a direction indicated with an arrow in FIG. 1 during an image forming operation due to driving force from a drive roller (not illustrated).

In the present exemplary embodiment, a contact electrification type charging unit is used. More specifically, the electro conductive roller 17 contacts the photosensitive drum 15 to evenly charge the entire surface of the photosensitive drum 15 by applying voltage to the electro conductive roller 17.

A scanner unit 30 is an exposure unit for forming a latent image on the photosensitive drum 15, whose surface has been evenly charged by the charging unit. More specifically, after receiving rasterized image data from a controller (not illustrated), a laser diode of the scanner unit 30 irradiates a polygonal mirror 31 with a laser beam based on the received image data.

The polygonal mirror 31 is rotated by the scanner motor 31*a* at a high speed. The laser beam reflected on the polygonal mirror 31 selectively exposes the surface of the photosensitive drum 15, which rotates at a constant speed, via an image forming lens and a reflection mirror 33.

A development unit, which forms a toner image on the photosensitive drum. 15, develops the latent image formed by the exposure unit on the photosensitive drum 15 by using a toner. The development unit includes the yellow development unit 20Y, the magenta development unit 20M, the cyan development unit 20C, and the black development unit 20Bk. Each of the yellow development unit 20Y, the magenta development unit 20M, the cyan development unit 20C, and the black development unit 20Bk contains a yellow, magenta, cyan, or black toner, respectively, as a developer.

In the following description, with respect to a color used in color image forming, yellow will be referred to as "Y". Similarly, magenta will be referred to as "M", cyan as "C", and black as "Bk".

Each of the development units is detachably mounted on and supported by the development rotary 23, which rotates around a rotation shaft 22. In forming a visible image, each development unit rotates around the shaft 22 while being supported by the development rotary 23.

After a development roller of the development unit for a color that is currently developed has stopped at a development position, at which the toner is applied onto the photosensitive drum 15, the corresponding development unit forms a visible image on the photosensitive drum 15.

During color image forming, the development rotary 23 rotates in synchronization with one rotation of the intermediate transfer member 9. Thus, each toner image for one color is formed by using the yellow development unit 20Y, the magenta development unit 20M, the cyan development unit 20C, and the black development unit 20Bk in this order.

By rotating the intermediate transfer member 9 for four rotations, toner images of yellow, magenta, cyan, and black are multiple-transferred to form color images on the intermediate transfer member 9.

In the example illustrated in FIG. 1, the yellow development unit 20Y is stopped at a development position corresponding to the drum unit 13. The yellow development unit 20Y feeds the toner to an application roller 20YR by using a mechanism for feeding the toner contained within a toner container provided therein. A blade 20YB, which is pressed against an outer periphery of the application roller 20YR and a development roller 20YS, applies the toner to form a thin toner layer and also charges the applied toner with a predetermined potential by friction charging.

In this state, a development bias is applied to the development roller 20YS, which faces the photosensitive drum 15 having the latent image formed thereon. Thus, the latent image formed on the photosensitive drum 15 is developed with the toner. The state in which the development is being executed on the photosensitive drum 15 will hereafter be referred to as an "in-contact state" while the state in which the development rotary 23 is rotating will hereafter be referred to as a "separated state".

The magenta development unit 20M, the cyan development unit 20C, and the black development unit 20Bk respectively execute development with the toner in the similar manner. A development roller of each color development unit is connected to a high voltage power supply for development of each color and to a drive source, each of which is provided on the image forming apparatus body. Accordingly, voltage is selectively and sequentially applied to the development roller of each development unit during development of each color.

The intermediate transfer member 9 rotates in a direction indicated by an arrow in FIG. 1 to multiple-transfer the toner image formed on the photosensitive drum 15. In the example illustrated in FIG. 1, the intermediate transfer member 9 is a belt. However, the present exemplary embodiment is not limited to a belt type. More specifically, it is also useful if an intermediate transfer drum or a transfer material bearing member is used.

By rotating four times, the intermediate transfer member 9 multiple-transfers each color toner image in order of yellow, magenta, cyan, and black. Thus, color images are formed on the intermediate transfer member 9.

In a non-image area of the outer periphery of the intermediate transfer member 9, an optical sensor 9*a* and a reference mark 9*b* are provided. The optical sensor 9*a* detects a reference mark 9*b*, which is a reference for determining timing to start image forming of each color.

An area detected by the optical sensor 9*a* is used as a position at which a reference mark 9*b* is detected. The reference mark 9*b* is not limited to a specific reference mark. More specifically, it is also useful if a reference mark 9*b* is previously provided on the intermediate transfer member 9 or formed before starting image forming by using the toner.

A cleaning unit removes and collects the toner remaining on the photosensitive drum 15 after the toner image formed by the development unit on the photosensitive drum 15 is transferred onto the intermediate transfer member 9. The waste toner removed from the photosensitive drum 15 is collected into the cleaner container 14.

A paper feed unit feeds a transfer material 2. The paper feed unit includes a cassette 1, a paper feed roller 3, and a registration roller 8. The cassette 1 stores a plurality of transfer materials 2. During a printing operation, the paper feed roller 3 is driven and rotates according as the printing operation progresses. The transfer material 2 is fed from the cassette 1 sheet by sheet. The sheet of the transfer material 2 fed in this manner then reaches the registration roller 8.

The registration roller 8 includes a shutter 11. The shutter 11 corrects skew-feeding, if any has occurred, of the transfer material 2, which has been conveyed to the registration roller 8. In addition, a leading edge detection sensor 6 is provided. The leading edge detection sensor 6 detects the transfer material 2 when the transfer material 2 reaches the shutter 11.

More specifically, the leading edge detection sensor 6 detects a leading edge of the transfer material 2. The transfer material 2 is then conveyed by the registration roller 8 to a secondary transfer unit in synchronization with the timing of the printing operation based on the result of detection by the leading edge detection sensor 6. Accordingly, in a secondary transfer, which is subsequent processing, the image having been formed on the intermediate transfer member 9 can be aligned with the transfer material 2.

The secondary transfer unit includes a secondary transfer roller 10 and a secondary transfer counter roller 5. The secondary transfer roller 10 can be separated from the intermediate transfer member 9. More specifically, the secondary transfer roller 10 can be controlled to contact and separate from the intermediate transfer member 9 as illustrated with a solid-line circle and a broken-line circle in the example illustrated in FIG. 1.

During the multiple-transfer of the color toner images on the intermediate transfer member 9, the secondary transfer roller 10 is controlled to move downwards to separate from the intermediate transfer member 9 as illustrated with the solid-line circle so that the toner images having been formed on the intermediate transfer member 9 may not be damaged.

After the color toner images are completely multiple-transferred on the intermediate transfer member 9, the secondary transfer roller 10 is moved by a cam member (not illustrated) to a position indicated by the broken line in FIG. 1 in synchronization with timing to secondary-transfer the images on the transfer material 2.

The secondary transfer roller 10, which has been moved downwards as described above, and the secondary transfer counter roller 5 apply pressure to the transfer material 2 and the intermediate transfer member 9 with a predetermined level of pressure. At the same time, a bias is applied to the secondary transfer roller 10. In this manner, the images on the intermediate transfer member 9 are transferred onto the transfer material 2.

Each of the intermediate transfer member 9 and the secondary transfer roller 10 is rotatably driven to execute the secondary transfer on the transfer material 2, which is pinched between the intermediate transfer member 9 and the secondary transfer roller 10. Concurrently with that, the secondary-transferred transfer material 2 is conveyed to the fixing unit 25. In the fixing unit 25, the transfer material 2 is subjected to fixing as subsequent processing.

The fixing unit 25 includes a fixing roller 26 and a pressure roller 27, which are used for fixing the images on the transfer material (recording medium) 2 by applying heat and pressure thereto. More specifically, the pressure roller 27 and the fixing roller 26 form a fixing nip portion N at a predetermined level of pressure therebetween. The fixing nip portion N has a predetermined width.

The recording medium 2 is conveyed from the transfer unit into a portion between the fixing roller 26 and the pressure roller 27 so that the surface thereof on which the images are to be formed faces the fixing roller 26. At this timing, the fixing nip N is heated to a predetermined temperature. The transfer material 2, which has been conveyed into the fixing nip N, is heated by the fixing roller 26 and pressed by the pressure roller 27. Thus, the transfer material 2 is thermally fixed.

The image forming apparatus according to the present exemplary embodiment has the above-described configuration.

Now, a series of operations for forming color images, which is executed by the color image forming apparatus having the above-described configuration, will be described in detail below.

At the start of an image forming operation, the paper feed roller 3 (FIG. 1) is rotated to feed one sheet of the transfer material (recording medium) 2 from the cassette 1. Then the fed recording medium 2 is conveyed to the registration roller 8. The recording medium 2 stays there until the images are completely formed on the intermediate transfer member 9.

During the image forming operation, the surface of the photosensitive drum 15 is evenly charged by the electro conductive roller 17. the scanner unit 30 forms a latent image of a Y image first. Concurrently with forming of the latent image, the yellow development unit 20Y is driven. In order to apply the yellow toner onto the latent image formed on the photosensitive drum 15 and execute development, voltage of the same polarity and substantially the same potential as those of the photosensitive drum 15 are applied.

To execute primary transfer of the toner images formed on the photosensitive drum 15 onto the intermediate transfer member 9, voltage opposite to that of the toner images formed on the photosensitive drum 15 is applied from the power supply unit (not illustrated) to a primary transfer roller 40. Thus, the toner images on the photosensitive drum 15 is primary-transferred onto the intermediate transfer member 9.

After the primary transfer of the toner image of yellow onto the intermediate transfer member 9 is completed, the development rotary 23 starts rotation and the magenta development unit 20M, which is the development unit of the color image to be subsequently formed, is rotated and moved. The magenta development unit 20M stops at the development position to form the image on the photosensitive drum 15.

Then, the photosensitive drum 15 is charged and the exposure is executed to form a latent image. From the latent image, a magenta toner image is formed in a manner similar to the yellow toner image.

The magenta toner image formed on the photosensitive drum 15 is then primary-transferred onto the intermediate transfer member 9 as in the processing for forming the yellow image. Subsequently, cyan and a black latent images are formed and developed, and developed toner images are primary-transferred onto the intermediate transfer member 9. Thus, a color image is formed by the multiple-transfer of four color toner images of yellow, magenta, cyan, and black.

After forming the color image onto the intermediate transfer member 9, the recording medium 2, which has been stopped at the registration roller 8, is conveyed.

The color image on the intermediate transfer member 9 is transferred onto the recording medium 2 by press-contacting the recording medium 2 against the intermediate transfer member 9 by the secondary transfer roller 10 and the secondary transfer counter roller 5. The secondary transfer roller 10 is provided with a bias with a polarity opposite to that of the toner.

After the color image is transferred from the intermediate transfer member 9 onto the recording medium 2, a charge roller 39 contacts the intermediate transfer member 9. The charge roller 39 charges the residual toner remaining on the intermediate transfer member 9 after the transfer, with a polarity opposite to the polarity with which the toner has been charged at the time of the development. The charge roller 39 will hereafter be simply referred to as the "ICL roller" 39.

After the charging of the residual toner is completed, the ICL roller 39 is separated from the intermediate transfer member 9. If images are serially formed, a yellow toner image of a subsequent image is formed on the photosensitive drum 15 while the ICL roller 39 is in contact with the intermediate transfer member 9 to charge the residual toner.

When the formed image passes a contact position with the ICL roller 39 after being primarily transferred on the intermediate transfer member 9, the ICL roller 39 is separated from the intermediate transfer member 9. The residual toner charged by the ICL roller 39 is electrostatically transferred on the photosensitive drum 15 by a primary transfer unit, with which the intermediate transfer member 9 is in contact. Then, the electrostatically transferred residual toner is collected by the cleaner blade 16 into the cleaner container 14.

The transfer of the residual toner onto the photosensitive drum 15, and the primary transfer of a toner image of yellow, which is a first color of a subsequent image, from the photosensitive drum 15 onto the intermediate transfer member 9 are executed at the same time. After the color image is completely secondary-transferred from the intermediate transfer member 9 onto the recording medium 2, the secondary transfer roller 10 is controlled to separate from the intermediate transfer member 9.

If a subsequent image (an image of a second page) is printed while conveying the recording medium 2 to a portion between the secondary transfer roller 10 and the intermediate transfer member 9 to secondarily transfer the color image, a yellow toner image of the subsequent image is formed on the photosensitive drum 15 at this timing.

After the yellow toner image is formed on the photosensitive drum 15 and before the forming of a magenta toner image of the subsequent image is started, the secondary transfer roller 10 is moved from the contact position for pinching the recording medium 2 with the intermediate transfer member 9, to the separation position.

After being separated from the intermediate transfer member 9, the recording medium 2 is conveyed to the fixing unit 25. The recording medium 2 is fixed in the fixing nip N. Then, the recording medium 2 is discharged onto a paper discharge tray 37, which is provided on the top portion of the color image forming apparatus body, via a discharge roller 36 with the image forming surface thereof facing down. Then, the image forming operation ends.

Figure 2:
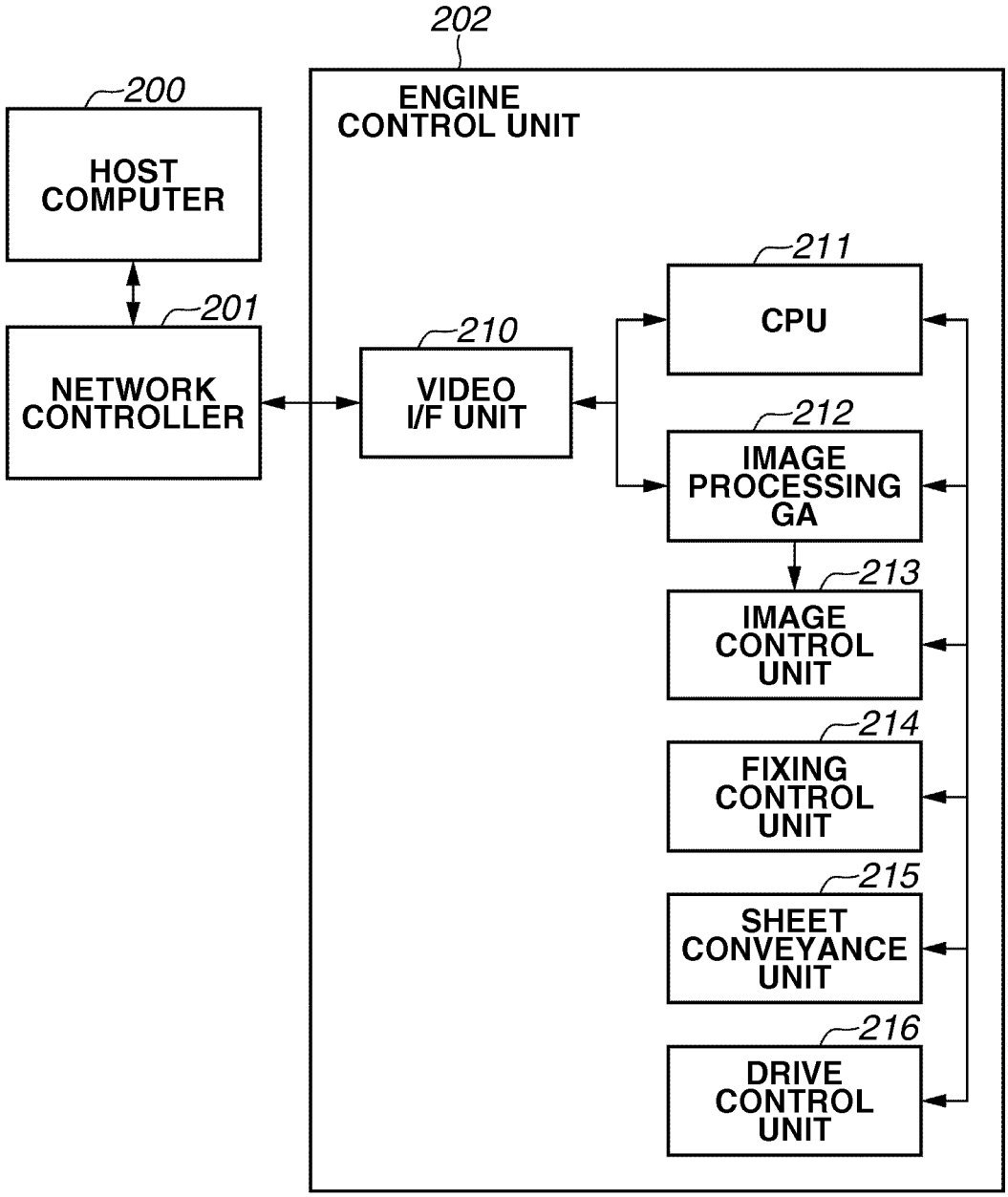
FIG. 2 is a block diagram illustrating an exemplary system configuration of a color image forming apparatus according to an exemplary embodiment of the present invention.

FIG. 2 is a block diagram illustrating an exemplary system configuration of the color image forming apparatus. Referring to FIG. 2, a host computer 200 transmits print data including Printer Control Language (PCL) data (i.e., data including character codes, graphic data, image data, and processing conditions) to the controller unit 201.

The controller unit 201 can execute data communication with the host computer 200 and the engine control unit 202. The controller unit 201 receives image information and a print command from the host computer 200. In addition, the controller unit 201 analyzes and converts the received image information into bitmap data.

The controller unit 201 transmits a print reservation command, print start command, and a video signal for each transfer material to the engine control unit 202 via a video interface (I/F) unit 210. More specifically, the controller unit 201 transmits the print reservation command to the engine control unit 202 according to the print command from the host computer 200. When the printing becomes ready, the controller unit 201 transmits the print start command to the engine control unit 202.

The engine control unit 202 executes preparation for printing in order of the received print reservation commands from the controller unit 201. Then, the engine control unit 202 waits for the print start command from the controller unit 201.

After receiving a print instruction (print start command), the engine control unit 202 transmits /TOP signals Y, M, C, and K. The /TOP signals Y, M, C, and K are used as a reference of timing to output a video signal of each color. Then, the engine control unit 202 starts a print operation according to the information included in the print reservation command.

Figure 3:
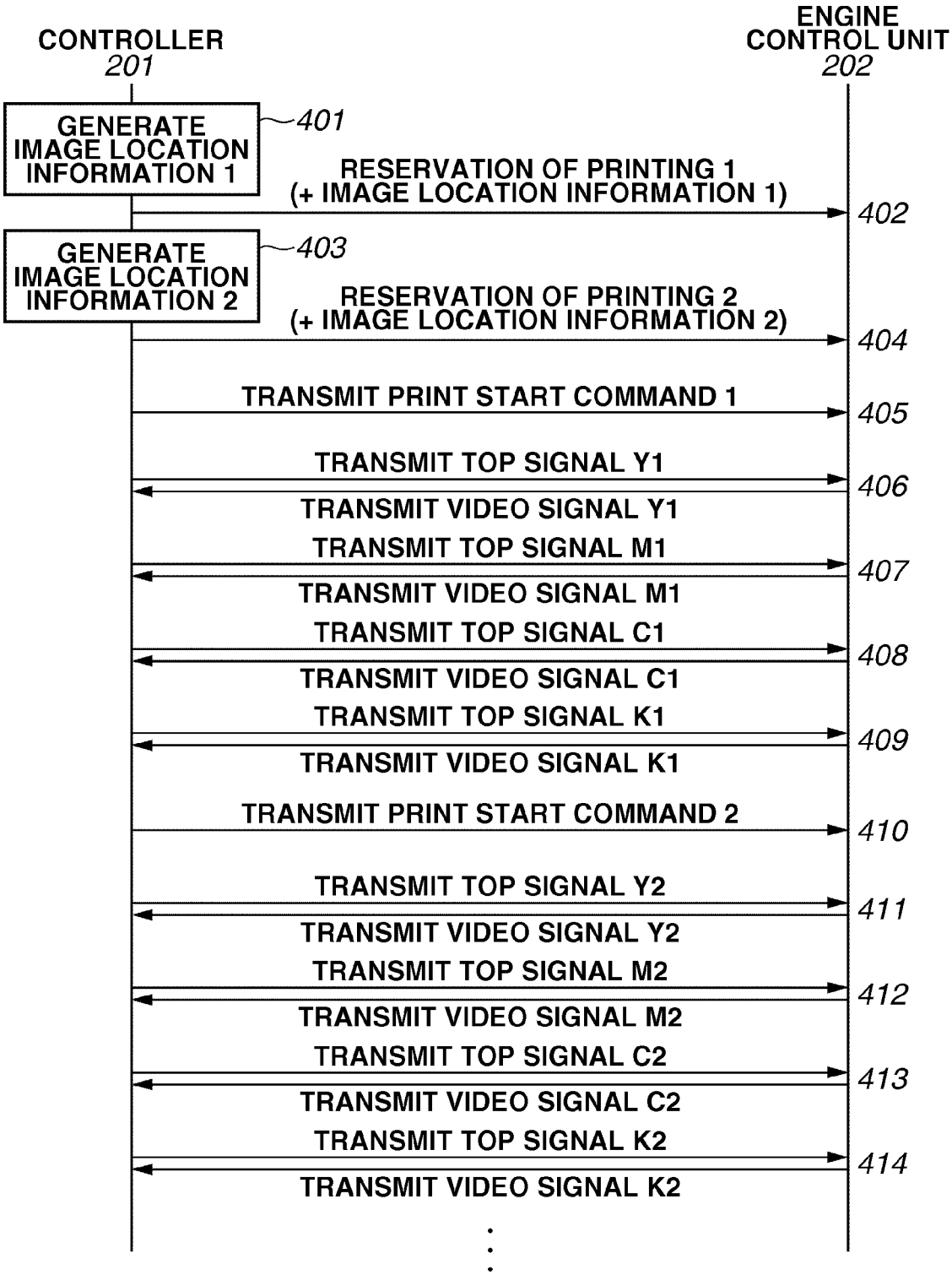
FIG. 3 illustrates an example of a communication sequence according to first and second exemplary embodiments of the present invention.

FIG. 3 illustrates an example of a communication sequence according to the present exemplary embodiment. Referring to FIG. 3, after receiving the print command from the host computer 200, the controller unit 201 transmits each color image location information 1 (timing 401) together with a print reservation command (timing 402).

If a plurality of print commands is received, the controller unit 201 transmits each color image location information 2 (timing 403) together with each corresponding print reservation command (timing 404).

Now, the image location information will be described in detail below.

Figure 4:
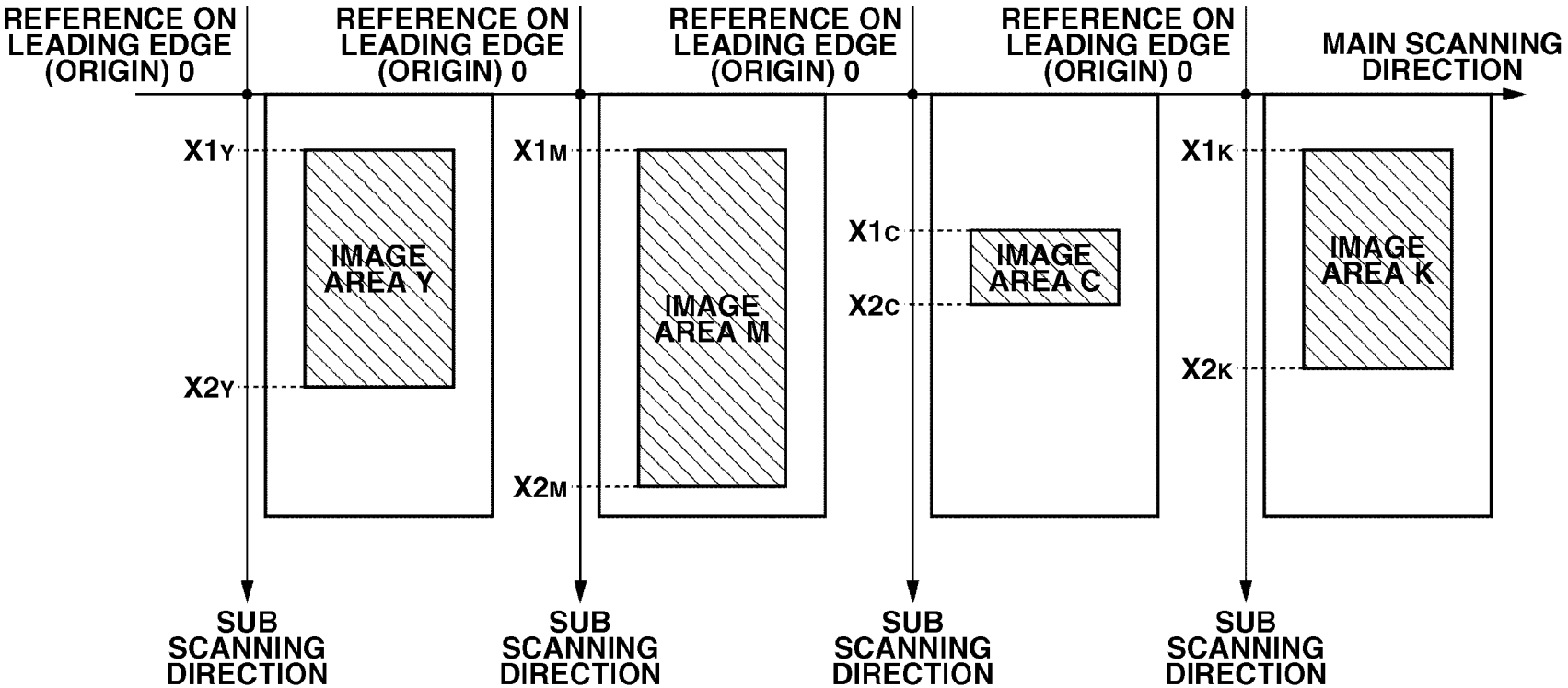
FIG. 4 illustrates an example of location information about each image according to an exemplary embodiment of the present invention.

FIG. 4 illustrates an example of image location information of each color ((X1Y, X2Y), (X1M, X2M), (X1C, X2C), (X1K, X2K)). The image location information about each color describes the location of a leading edge of a transfer material 2 as an origin O. The image location information about each color describes the location of the leading edge of each color image in a sub scanning direction (X1Y, X1M, X1C, X1K) and the location of the trailing edge of each color image in the sub scanning direction (X2Y, X2M, X2C, X2K).

The controller unit 201 transmits a print reservation command 1 to the engine control unit 202 before transmitting a print start command 1 thereto (timing 405). After receiving the print start command 1, the engine control unit 202 transmits a /TOP signal Y1 if a reference mark is detected (timing 406) to start a print operation.

After the print operation is started, the engine control unit 202, based on each color image location information 1 (received at the timing 401), transmits /TOP signals M1, C1, and K1 to the controller unit 201 (timings 407 through 409).

After receiving the /TOP signals Y1, M1, C1, and K1 (at the timings 406 through 409), the controller unit 201 transmits video signals Y1, M1, C1, and K1, each of which is image data of corresponding color, to the engine control unit 202.

Then, the controller unit 201 outputs a print start command 2 (timing 410) corresponding to a subsequent print reservation command 2 (timing 403). After that, in the manner similar to that used in forming the first image, the controller unit 201 and the engine control unit 202 executes data communication to form subsequent images.

Figure 5:
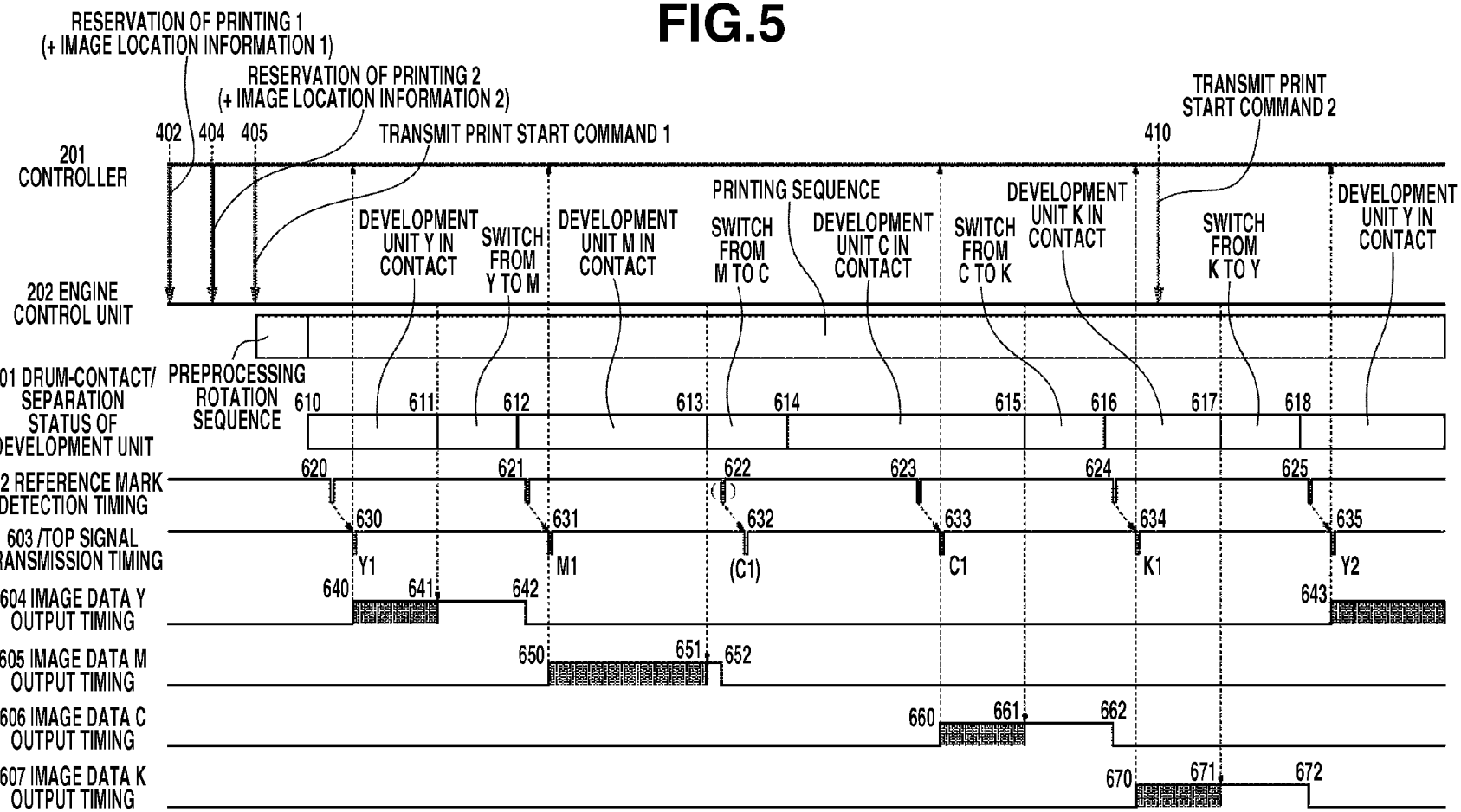
FIG. 5 is a timing chart illustrating exemplary timing of image forming executed by a color image forming apparatus according to a first exemplary embodiment of the present invention.

FIG. 5 is a timing chart illustrating exemplary timing of image forming executed by the color image forming apparatus according to the present exemplary embodiment. Referring to FIG. 5, it is supposed, as can be known from the image area information illustrated in FIG. 4, that the size of an image trailing edge margin for Y, C, and K color image in the longitudinal direction is larger than the time taken to switch the development unit.

After receiving the print reservation command 1 and the each color image location information 1 from the controller unit 201 (timing 401) and the print start command (timing 405), the engine control unit 202 starts the preprocessing rotation sequence.

In the present exemplary embodiment, the "preprocessing rotation sequence" refers to predetermined processing to be executed to prepare for executing image forming. More specifically, the preprocessing rotation sequence refers to the predetermined processing for rotating the photosensitive drum 15 for a predetermined period of time to stabilize the potential of the surface thereof and activating an actuator necessary for forming an image. Therefore, the engine control unit 202 previously stores the time necessary for the preprocessing rotation sequence, on a read-only memory (ROM) (not illustrated) as data.

After the preprocessing rotation sequence has been completed (timing 610), the engine control unit 202 transmits a /TOP signal Y1 to the controller unit 201 (timing 630) to start the print operation for the first page. After receiving the /TOP signal Y1 (timing 630), the controller unit 201 outputs a video signal Y1, which is Y image data (timing 640).

The engine control unit 202 calculates a contact time of the development unit (=X2Y/the speed of travel of the intermediate transfer member 9) based on the trailing edge location (X2Y) of an image area Y (X1Y, X2Y) of the image location information 1 (FIG. 5) included in the print reservation command 1.

When the calculated contact time of the development unit elapses (timing 641), the engine control unit 202 starts switching of the development unit (timing 611). Furthermore, the engine control unit 202 compares end timing of switching of the development unit (timing 612) and timing to detect a reference mark of a subsequent color (timing 621).

In the present exemplary embodiment, it is supposed that the development unit of the subsequent color magenta has already contacted the photosensitive drum 15 and thus image forming can be started at this timing. Accordingly, the engine control unit 202 transmits a /TOP signal M1 to the controller unit 201 (timing 631).

The operation executed under the above-described conditions will be described in detail below by using specific numerical values.

Suppose that the longitudinal dimension (length) of the intermediate transfer member 9 is 380 mm, that the speed of travel of the intermediate transfer member 9 is 100 mm/s, that the development unit switching time is 610 ms, and that the trailing edge location X2Y is 300 mm. Under these conditions, the time taken for the intermediate transfer member 9 to rotate by one revolution is 380/100=3.8 seconds. The time taken for executing the image forming to the trailing edge location is 300/100=3 seconds.

Accordingly, if the switching of the development unit is started immediately after the end of the image forming, then a time period corresponding to the trailing edge margin, i.e., the time period from start of switching of the development unit to detection of a subsequent reference mark (a first time period), can be calculated as the difference between the above-described time periods. Accordingly, the extraction processing corresponding to the trailing edge margin=3.8−3.0=0.8 seconds=800 ms.

Therefore, the development unit switching time (a second time period) 610 ms<the time corresponding to the trailing edge margin 800 ms. Accordingly, the switching of the development unit can be completed within the time corresponding to the trailing edge margin.

In addition, it is also useful if the switching of the development unit is executed by using the longitudinal dimension (length) of an image to be formed as the reference instead of using time as the reference. More specifically, if the switching of the development unit is executed immediately after the end of the image forming under the same conditions as those described above, then it is useful if the length of the image to be formed is such that a trailing edge margin is longer enough than the development unit switching time 610 ms.

In the present exemplary embodiment, the length of an image to be formed with which the trailing edge margin becomes 610 ms is 0.61 (s)×100 (mm/s)=61 (mm). Since the length of the intermediate transfer member is 380 mm, the difference between the length of the intermediate transfer member 9 and the above-described length of the trailing edge margin is 380 (mm)−61 (mm)=319 (mm). Therefore, if the length of an image to be formed is shorter than 319 mm, it can be determined that the switching of the development unit can be completed during the time period corresponding to the trailing edge margin.

The above-described numerical values in the present case, that is, the development unit switching time and the image length, are mere examples. Numerical values arbitrarily determined according to characteristics of an image forming apparatus can be appropriately set.

After receiving the /TOP signal M1 (timing 631), the controller unit 201 transmits a video signal M1, which is M image data, to the engine control unit 202 (timing 650).

The engine control unit 202 calculates a time period of contact of the development unit (=X2M/the traveling speed of the intermediate transfer member 9) based on the trailing edge location (X2M) of an image area M (X1M, X2M) of the image location information 1 included in the print reservation command 1 (FIG. 5).

When the calculated development unit contact time elapses (timing 651), the engine control unit 202 starts the switching of the development unit (timing 613). Furthermore, the engine control unit 202 compares timing to end the switching of the development unit (timing 614) and timing to detect a reference mark of a subsequent color (timing 622).

When the reference mark is detected (timing 622), the switching of the development unit from the development unit M to the development unit C is not yet completed. Therefore, the engine control unit 202 does not transmit a /TOP signal C1 to the controller unit 201 at this timing.

By using a time period from when the reference mark is detected (timing 622) to when a subsequent reference mark is detected after one rotation of the intermediate transfer member 9 (timing 633) as the reference, the engine control unit 202 transmits a /TOP signal C1 to the controller unit 201 (timing 633).

After receiving the /TOP signal C1 from the controller unit 201 (timing 633), the controller unit 201 transmits a video signal C1, which is C image data, to the engine control unit 202 (timing 660). Then, with respect to the colors C and K, the engine control unit 202 calculates a development unit contact time by executing processing similar to that for the colors Y and M described above based on image location information.

If the time corresponding to the trailing edge margin is longer than the development unit switching time, then the present exemplary embodiment executes image forming of a subsequent color without idling the intermediate transfer member 9.

After the images of four colors of Y, M, C, and K are completely formed, the engine control unit 202 transfers the color image formed on the intermediate transfer member 9 onto the transfer material 2. If no image forming reservation command has been received, then the post processing rotation sequence is executed. During the post processing rotation sequence, the high voltage power supply for each development unit is discontinued and the driving of the actuator is suspended.

FIG. 6 is a flow chart illustrating an example of a print operation according to the present exemplary embodiment.

Referring to FIG. 6, in step S701, the engine control unit 202 determines whether a print reservation command has been received together with image location information about each color. If it is determined that a print reservation command and image location information about each color have been received (Yes in step S701), then the processing advances to step S702. In step S702, the engine control unit 202 waits until a print start command is received (determines whether a print start command has been received). If it is determined that a print start command has been received (Yes in step S702), then the processing advances to step S703. In step S703, the engine control unit 202 executes the preprocessing rotation sequence.

After the preprocessing rotation sequence is completed, the processing advances to step S704. In step S704, the engine control unit 202 determines whether a reference mark has been detected. If it is determined that a reference mark has been detected (Yes in step S704), then the processing advances to step S705. In step S705, the engine control unit 202 outputs a /TOP signal Y and starts the print operation according to the received print reservation command for a first page.

In step S706, the engine control unit 202 calculates the contact time of the development unit (=the image trailing edge location/the traveling speed of the intermediate transfer member 9) based on the image location information Y.

After calculating the development unit contact time, the processing advances to step S707. In step S707, the engine control unit 202 waits until the Y image is formed. More specifically, in step S707, the engine control unit 202 determines whether the image forming completion time has elapsed (i.e., whether the image forming on the trailing edge of the image has been completed). If it is determined that the image forming completion time has elapsed (Yes in step S707), then the processing advances to step S708. In step S708, the engine control unit 202 switches the development unit. Then, the processing advances to step S709.

In step S709, the engine control unit 202 compares the development unit switching completion timing and timing for outputting a /TOP signal of a subsequent color and determines whether /TOP signals of all colors of Y, M, C, and K have been transmitted. If it is determined that /TOP signals of all colors of Y, M, C, and K have been transmitted (Yes in step S709), then the processing advances to step S711. On the other hand, if it is determined that /TOP signals of all colors of Y, M, C, and K have not been transmitted yet (No in step S709), then the processing advances to step S710.

In step S710, the engine control unit 202 executes /TOP signal transmission determination processing in steps S714 through S717. More specifically, in step S714, the engine control unit 202 measures the time elapsed since the start of switching of the development unit.

In step S715, the engine control unit 202 determines whether a reference mark of the subsequent color has been detected. If it is determined that a reference mark of the subsequent color has been detected (Yes in step S715), then the processing advances to step S716. In step S716, the engine control unit 202 determines whether the development unit switching time is equal to or shorter than the elapsed time (the time taken until a reference mark of the subsequent color is detected).

If it is determined that the development unit switching time is equal to or shorter than the elapsed time (Yes in step S716), then the predefined processing in step S710 ends and the processing returns to step S705. In step S705, the engine control unit 202 determines that the development unit has already contacted the photosensitive drum 15 at the timing to transmit the /TOP signal of the subsequent color and outputs a /TOP signal M.

On the other hand, if it is determined that the development unit switching time is greater than the elapsed time (No in step S716), then the processing advances to step S717. In step S717, the engine control unit 202 determines that the switching of the development unit is currently executed when the /TOP signal of the subsequent color is transmitted.

Accordingly, in step S717, the engine control unit 202 executes control for idling the intermediate transfer member 9 by one rotation before determining whether a subsequent reference mark has been detected. If it is determined that a subsequent reference mark has been detected (Yes in step S717), then the predefined processing ends and the processing returns to step S705. In step S705, the engine control unit 202 outputs a /TOP signal M.

After transmitting /TOP signals of all the colors in step S709, the processing advances to step S711. In step S711, the engine control unit 202 determines whether a subsequent print reservation command and a subsequent print start command have been received. If it is determined that a subsequent print reservation command and a subsequent print start command have been received (Yes in step S711), then the processing advances to step S712.

In step S712, the engine control unit 202 executes /TOP signal transmission determination processing in steps S714 through S717 for a first color of the subsequent print reservation. Then, the engine control unit 202 repeats the processing in step S705 and beyond to continue the processing for printing a subsequent page. On the other hand, if it is determined that neither a subsequent print reservation command nor a subsequent print start command has been received (No in step S711), then the processing advances to step S713. In step S713, the engine control unit 202 executes the post processing rotation sequence. Then, the print operation ends.

In the present exemplary embodiment, the controller unit 201 transmits image location information together with a print reservation command. However, the present exemplary embodiment is not limited to this. More specifically, the timing of transmission of image location information can be appropriately changed if the image location information is transmitted before the start of the calculation of the trailing edge margin of the image area by transmitting the same before transmitting a print reservation command, for example.

As described above, in the present exemplary embodiment, the engine control unit 202 changes the development unit switching time according to the image location information about the trailing edge of the image and changes the determination as to the transmission of a /TOP signal of each color. Therefore, the present exemplary embodiment can suppress idling of the intermediate transfer member 9. Accordingly, the present exemplary embodiment can reduce the time taken for image forming.

The above-described exemplary embodiment of the present invention can be variously modified according to the effects of the present invention. Such a modification of the above-described exemplary embodiment of the present invention is included in the scope of the present invention.

In the above-described first exemplary embodiment, the engine control unit 202 calculates the trailing edge margin based on the image location information and changes the development unit switching timing based on the calculated trailing edge margin. If it is determined that the switching of the development unit is completed before the subsequent color reference mark detection timing, then the engine control unit 202 does not idle the intermediate transfer member 9 by one rotation. Thus, the first exemplary embodiment executes printing.

However, if the trailing edge margin is small just as in the image area M (FIG. 5) and if the switching of the development unit is not completed before the subsequent reference mark detection timing, the first exemplary embodiment idles the intermediate transfer member 9 by one rotation.

In a second exemplary embodiment of the present invention, the engine control unit 202 changes the development unit switching completion timing based both on the trailing edge margin of a current color and a leading edge margin of a subsequent color so as not to idle the intermediate transfer member 9 by one rotation during printing.

The units, components, processing, and the like similar to those of the first exemplary embodiment are provided with the same reference symbols and numerals as those of the first exemplary embodiment. Accordingly, the description thereof will not be repeated here.

Figure 7:
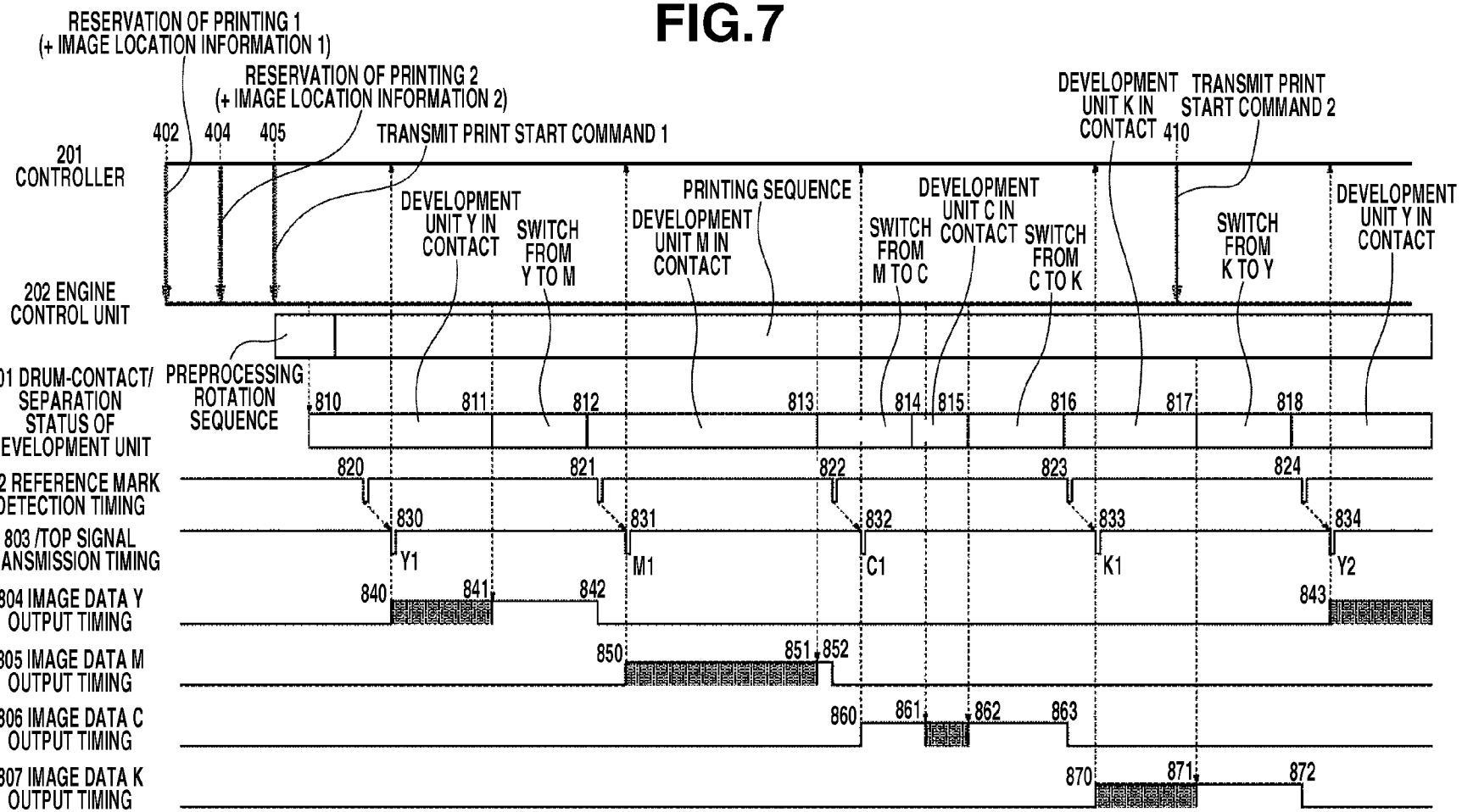
FIG. 7 is a timing chart illustrating exemplary timing of image forming executed by a color image forming apparatus according to a second exemplary embodiment of the present invention.

FIG. 7 is a timing chart illustrating an example of image forming according to the present exemplary embodiment. Similarly to the first exemplary embodiment, the image forming timing illustrated in FIG. 7 will be described in detail below based on the image area information illustrated in FIG. 4.

As characteristic points of the control illustrated in FIG. 7, the engine control unit 202 according to the present exemplary embodiment executes the control in switching the development unit from the development unit M to the development unit C if the switching of the development unit cannot be completed within the time corresponding to the trailing edge margin of an M image.

In the present exemplary embodiment, in switching the development unit for the colors other than magenta and cyan, the same operation as the operation for switching the development unit from the development unit M to the development unit C can be executed. Accordingly, the switching of the development unit from the development unit M to the development unit C will be described in detail as a representative operation. Therefore, the operation for switching the development unit for the other colors will not be described in detail here.

Referring to FIG. 7, when a /TOP signal M1 is received from the engine control unit 202 (timing 831), the controller unit 201 transmits a video signal M1, which is M image data, to the engine control unit 202 (timing 850). Then, the engine control unit 202 calculates a contact time of the development unit (=X2M/the traveling speed of the intermediate transfer member 9) based on the trailing edge location (X2M) of an image area M (X1M, X2M) of the image location information 1 included in the print reservation command 1 (FIG. 5).

When the calculated development unit contact time elapses (timing 851), the engine control unit 202 starts the switching of the development unit (timing 813). Furthermore, the engine control unit 202 compares timing to end switching of the development unit (timing 814) and timing to detect a reference mark of a subsequent color (timing 832).

When the reference mark is detected (timing 832), the switching of the development unit from the development unit M to the development unit C is not completed. Therefore, the switching of the development unit cannot be completed within the time period corresponding to the trailing edge margin of the image area M.

Accordingly, the engine control unit 202 calculates timing to start image forming of the C image based on the leading edge margin of the image area C, which is the subsequent color and determines whether the switching of the development unit is completed before forming the C image.

In the above-described first exemplary embodiment, the time corresponding to the trailing edge margin is referred to as the "first time period". In the present exemplary embodiment, the total time period corresponding to a trailing edge margin of a current color and a leading edge margin of a subsequent color will be referred to as a "third time period".

The engine control unit 202 calculates a time period corresponding to the leading edge margin of an the M image (=X1C/the traveling speed of the intermediate transfer member 9) based on the leading edge location (X1C) of an image area C (X1C, X2C) of the image location information 1 included in the print reservation command 1 (FIG. 5).

By comparing the development unit switching completion timing (timing 814) and a reference mark detection timing of a subsequent color (timing 822), it is recognized that the switching of the development unit is currently executed at the timing to detect the reference mark (timing 822).

Accordingly, the engine control unit 202 adds the time corresponding to the trailing edge margin of the image area M (timings 851 and 852) and the leading edge margin of the image area C calculated in the above-described manner (timings 860 and 861). Furthermore, the engine control unit 202 compares the resulting total time with the development unit switching completion timing (timing 814).

As a result, it is recognized that the switching of the development unit has been completed before image forming on the leading edge of the image area C (timing 861). Accordingly, the engine control unit 202 does not idle the intermediate transfer member 9 by one rotation and transmits a /TOP signal C1 to the controller unit 201 (timing 832).

As described above, if the switching of the development unit is not completed within the time corresponding to the trailing edge margin of the image area and thus it is necessary to idle the intermediate transfer member 9, the engine control unit 202 adds the time corresponding to the trailing edge margin and the time corresponding to the leading edge margin of the image area of the subsequent color and compares the resulting time with the development unit switching time.

If it is determined that the time corresponding to (the trailing edge margin+the leading edge margin of the subsequent color)>the development unit switching time, then the image forming can be executed without idling the intermediate transfer member 9 by one rotation.

In addition, as in the first exemplary embodiment, it is also useful if the switching of the development unit is executed by using the longitudinal dimension (length) of an image to be formed as the reference instead of using time as the reference. More specifically, if the length calculated by (the trailing edge margin+the leading edge margin of the subsequent color) is longer than 61 mm corresponding to the development unit switching time as described above, then the image forming can be executed without idling the intermediate transfer member 9 by one rotation.

FIG. 8 is a flow chart illustrating an example of a print operation according to the present exemplary embodiment. In the example illustrated in FIG. 8, processing in steps S901 through S913 is similar to that in steps S701 through S713 (FIG. 7) in the above-described first exemplary embodiment. Accordingly, the description thereof will not be repeated here.

Referring to FIG. 8, in step S914, the engine control unit 202 measures the time elapsed since the start of switching of the development unit. In step S915, the engine control unit 202 determines whether a subsequent reference mark has been detected. If it is determined that a subsequent reference mark has been detected (Yes in step S915), then the processing advances to step S916.

In step S916, the engine control unit 202 determines whether the development unit switching completion time is longer than the elapsed time (the subsequent color reference mark detection timing). If it is determined that the development unit switching time is equal to or shorter than the elapsed time (Yes in step S916), then the predefined processing in step S910 ends and the processing returns to step S905. In step S905, the engine control unit 202 determines that the development unit has already contacted the photosensitive drum 15 at the timing to transmit a /TOP signal of the subsequent color. Accordingly, the engine control unit 202 outputs a /TOP signal M.

On the other hand, if it is determined that the development unit switching time is longer than the elapsed time (No in step S916), then the processing advances to step S917. In this case, the engine control unit 202 determines that the switching of the development unit has not been completed at the timing to transmit the /TOP signal of the subsequent color. Accordingly, in step S917, the engine control unit 202 calculates a leading edge margin time of the image area M (=the leading edge location of the image M/the traveling speed of the intermediate transfer member 9 of the image the area M).

After calculating the leading edge margin time period in step S917, the processing advances to step S918. In step S918, the engine control unit 202 determines whether the development unit switching completion time is equal to or shorter than the total of the elapsed time and the image M leading edge margin time.

If it is determined that the development unit switching completion time is equal to or shorter than the total of the elapsed time and the image M leading edge margin time (Yes in step S918), then the engine control unit 202 determines that the switching of the development unit is completed before the timing to start forming the image on the leading edge margin of the image area M and that thus the development unit contacts the photosensitive drum 15. Then, the predefined processing ends and the processing returns to step S905. In step S905, the engine control unit 202 outputs a /TOP signal M.

On the other hand, if it is determined that the development unit switching completion time is longer than the total of the elapsed time and the image M leading edge margin time (No in step S917), then the engine control unit 202 determines that the switching of the development unit is not completed yet at the timing to start forming the leading edge image of the image area M. More specifically, at this timing, it has been determined that the intermediate transfer member 9 is to be idled to contact the photosensitive drum 15. Then, the processing advances to step S919.

In step S919, the engine control unit 202 determines whether a subsequent reference mark has been detected. If it is determined that a subsequent reference mark has been detected (Yes in step S919), then the predefined processing in step S910 ends and the processing returns to step S905. In step S905, the engine control unit 202 outputs a /TOP signal M.

After transmitting /TOP signals of all the colors in step S909, the processing advances to step S911. In step S911, the engine control unit 202 determines whether a subsequent print reservation command and a subsequent print start command has been received. If it is determined that a subsequent print reservation command and a subsequent print start command have been received (Yes in step S911), then the processing advances to step S912.

In step S912, the engine control unit 202 executes /TOP signal transmission determination processing in steps S914 through S917 for a first color of the subsequent print reservation. Then, the engine control unit 202 repeats the processing in step S905 and beyond to continue the processing for printing a subsequent page. On the other hand, if it is determined that neither a subsequent print reservation command nor a subsequent print start command has been received (No in step S911), then the processing advances to step S913. In step S913, the engine control unit 202 executes the post processing rotation sequence. Then, the print operation ends.

In the present exemplary embodiment, the controller unit 201 transmits image location information together with a print reservation command. However, the present exemplary embodiment is not limited to this. More specifically, the timing to transmit image location information can be appropriately changed if the image location information is transmitted before the start of the calculation of the trailing edge margin and the leading edge margin of the image area. For example, the image location information is transmitted before transmitting a print reservation command.

In the present exemplary embodiment, the total of the time corresponding to the trailing edge margin and the time corresponding to the subsequent color leading edge margin, and the development unit switching time are compared to make the determination. However, the present exemplary embodiment is not limited to this. More specifically, a time period from the start of the switching of the development unit to when the image forming on the subsequent color leading edge margin is completed may also be used (a "fourth time period"). In this case, the fourth time period may also be used instead of the third time period described above.

As described above, in the present exemplary embodiment, the engine control unit 202 changes the development unit switching time according to the image location information about the trailing edge of the image and the leading edge of the subsequent image and changes the determination as to the transmission of a /TOP signal of each color. Therefore, the present exemplary embodiment can suppress idling of the intermediate transfer member 9. Accordingly, the present exemplary embodiment can reduce the time taken for image forming.

In the above-described first and the second exemplary embodiments, the method for controlling the switching of the development unit during forming of one image. However, if a plurality of serially given print commands has been acquired, the above-described development unit switching control method can also be implemented to switch the development unit during the forming of a plurality of images.

More specifically, if the development unit is completely switched after a first image (K image) is completely formed and before starting the image forming of a Y image, which is a second image, then the image forming of the image Y, which is the second image, can be started without idling the intermediate transfer member 9.

In the above-described first and the second exemplary embodiments, the engine control unit 202 receives information about image forming for each color. However, the present exemplary embodiment is not limited to this. More specifically, it is also useful if the engine control unit 202 receives image forming information necessary for forming one image and calculates information about the other color images.

It is also useful if the engine control unit 202 receives image forming information for one job including a plurality of images and calculates information about each color of one image.

The above-described exemplary embodiment of the present invention can be variously modified according to the effects of the present invention. Such a modification of the above-described exemplary embodiment of the present invention is included in the scope of the present invention.

In the above-described first and the second exemplary embodiments, the engine control unit 202 previously receives image location information of each color from the controller unit 201 before starting printing. Furthermore, the engine control unit 202 calculates a development unit contact time based on the received image location information.

In a third exemplary embodiment of the present invention, the controller unit 201 calculates the development unit contact time of each color and transmits the result of calculation to the engine control unit 202. The engine control unit 202 executes the switching of the development unit based on the calculation result received from the controller unit 201.

Figure 9:
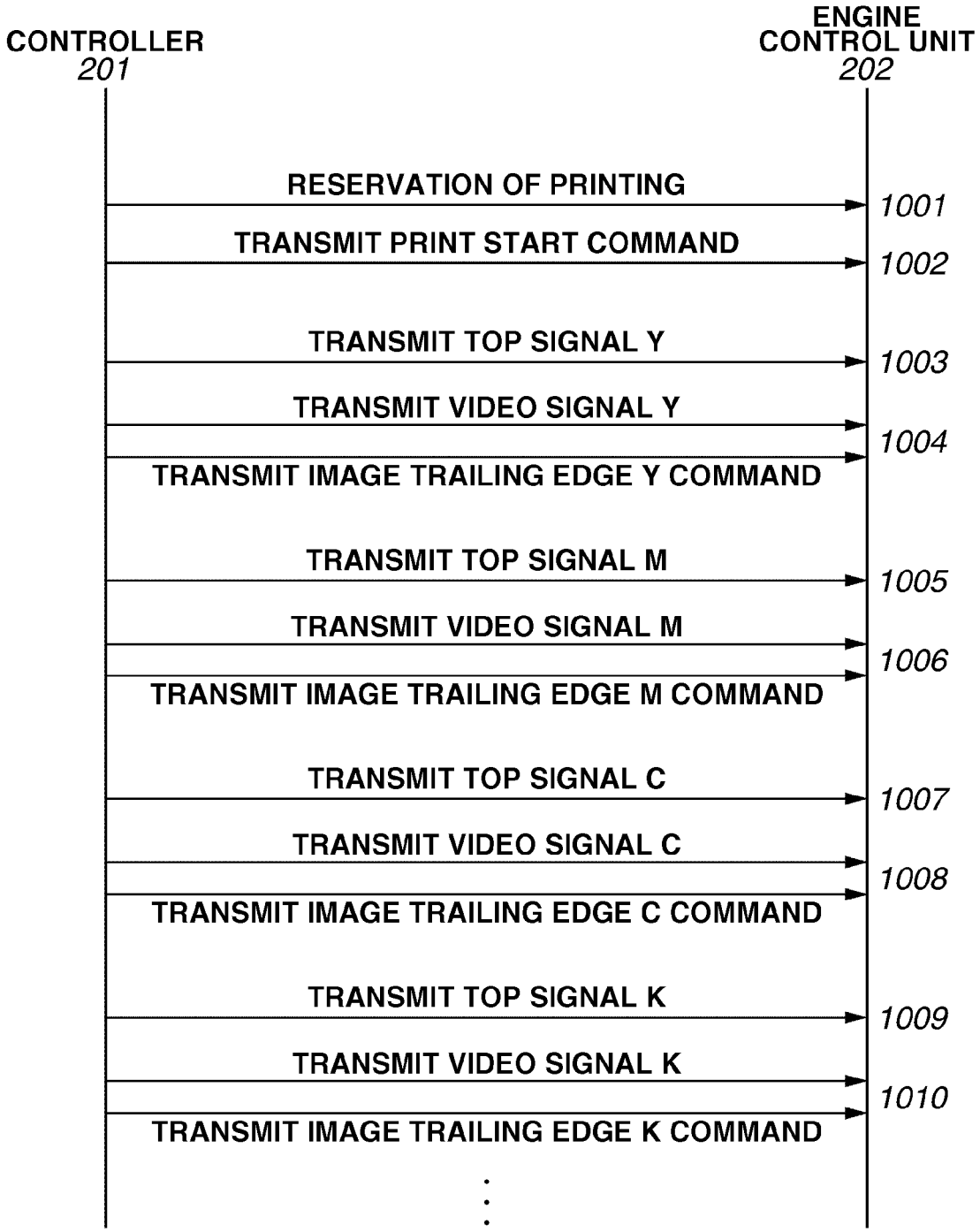
FIG. 9 illustrates an example of a communication sequence according to a third exemplary embodiment of the present invention.

FIG. 9 illustrates an example of a communication sequence according to the present exemplary embodiment. Referring to FIG. 9, at timing 1001, when a print command is received from the host computer 200, the controller unit 201 transmits a print reservation command to the engine control unit 202.

After transmitting the print reservation command at the timing 1001, the processing advances to processing corresponding to a timing 1002. At the timing 1002, the controller unit 201 transmits a print start command. After the engine control unit 202 has received the print start command from the controller unit 201, the processing advances to processing corresponding to timing 1003. At the timing 1003, the engine control unit 202 transmits a /TOP signal Y to the controller unit 201 if a reference mark is detected. In addition, the engine control unit 202 starts a print operation.

After receiving the /TOP signal Y from the controller unit 201 at the timing 1003, the processing advances to processing corresponding to timing 1004. At a timing 1004, the controller unit 201 transmits a video signal Y to the engine control unit 202 before transmitting an image trailing edge Y command thereto.

After receiving the image trailing edge Y command from the controller unit 201 at the timing 1004, the engine control unit 202 switches the development unit and compares the time corresponding to the trailing edge margin of the image, which is included in the received image trailing edge command Y, with the development unit switching time.

In addition, at the timing 1004, the engine control unit 202 determines whether the development unit is completely switched before a subsequent color reference mark is detected. If it is determined that the development unit is completely switched before the subsequent color reference mark is detected, then the processing advances to processing corresponding to timing 1005. At the timing 1005, the engine control unit 202 transmits a /TOP signal M.

In the processing beyond, in the manner similar to that described above, after receiving /TOP signals M, C, and K at timings 1005, 1007, and 1009, the controller unit 201 transmits a video signal of each color, which is image data.

After transmitting the video signal in the above-described manner, then at timings 1006, 1008, and 1010, the controller unit 201 transmits image trailing edge commands M, C, and K. After receiving the image trailing edge commands at the timings 1006 and 1008, the engine control unit 202 switches the development unit. At this timing, the engine control unit 202 compares the time corresponding to the image trailing edge margin, which is included in each of the received image trailing edge commands, with the development unit switching time.

The engine control unit 202 determines whether the development unit is completely switched before a subsequent color reference mark is detected. At timings 1007 and 1009, the engine control unit 202 transmits /TOP signals C and K.

The engine control unit 202 determines whether the development unit is completely switched before the subsequent color reference mark is detected. If it is determined that the development unit is completely switched before detecting the subsequent color reference mark, then the processing advances to processing corresponding to timings 1007 and 1009. At the timings 1007 and 1009, the engine control unit 202 transmits /TOP signals C and K to the controller unit 201.

Figure 10:
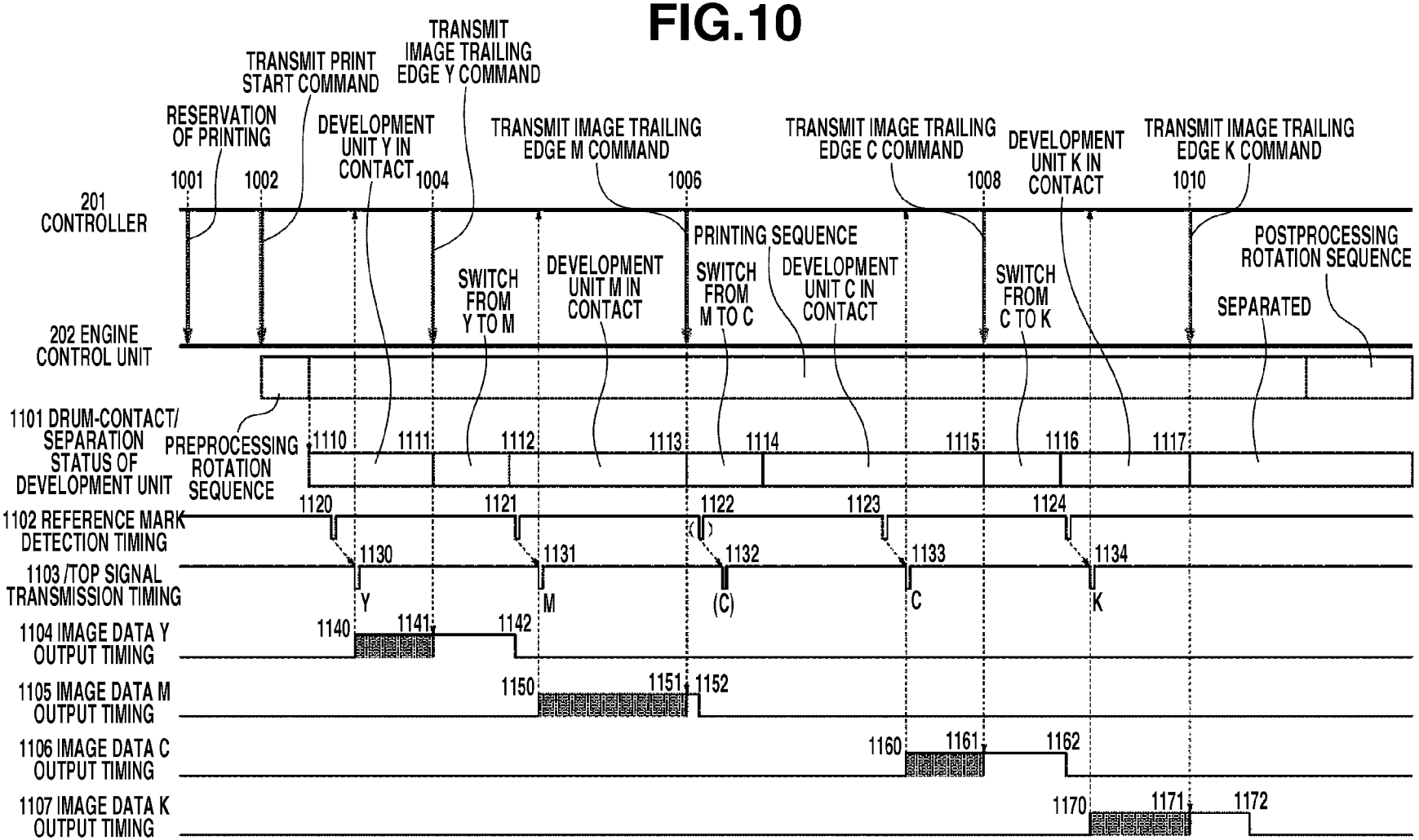
FIG. 10 is a timing chart illustrating exemplary timing of image forming executed by a color image forming apparatus according to the third exemplary embodiment of the present invention.

FIG. 10 is a timing chart illustrating an example of timing to execute the processing during image forming according to the present exemplary embodiment.

Referring to FIG. 10, after receiving the print reservation command and the print start command at the timings 1001 and 1002 as described above, the engine control unit 202 starts the preprocessing rotation sequence. After completing the preprocessing rotation sequence at timing 1110, if a reference mark is detected at timing 1120, the engine control unit 202 transmits a /TOP signal Y to the controller unit 201 at timing 1130. At this timing, the engine control unit 202 starts the print operation for printing a first page.

After receiving the /TOP signal Y at the timing 1130, the controller unit 201 transmits a video signal Y, which is Y image data, to the engine control unit 202 at timing 1140.

After the video signal Y is transmitted at timing 1141, the controller unit 201 transmits the image trailing edge Y command to the engine control unit 202 at the timing 1004. After receiving the image trailing edge Y command at the timing 1004, the engine control unit 202 starts the switching of the development unit at timing 1111. Then, the engine control unit 202 compares a development unit switching completion timing (timing 1112) and a subsequent color reference mark detection timing (timing 1121).

In the present exemplary embodiment, when the reference mark is detected (timing 1121), the development unit M has already contacted the photosensitive drum 15. Accordingly, at timing 1131, the engine control unit 202 transmits a /TOP signal M to the controller unit 201.

For the other colors M, C, and K, the engine control unit 202 transmits an image trailing edge command M, C, or K at the same timing as that for the color Y (at the timings 1006, 1008, and 1010). Accordingly, the description thereof will not be repeated here.

Figure 11:
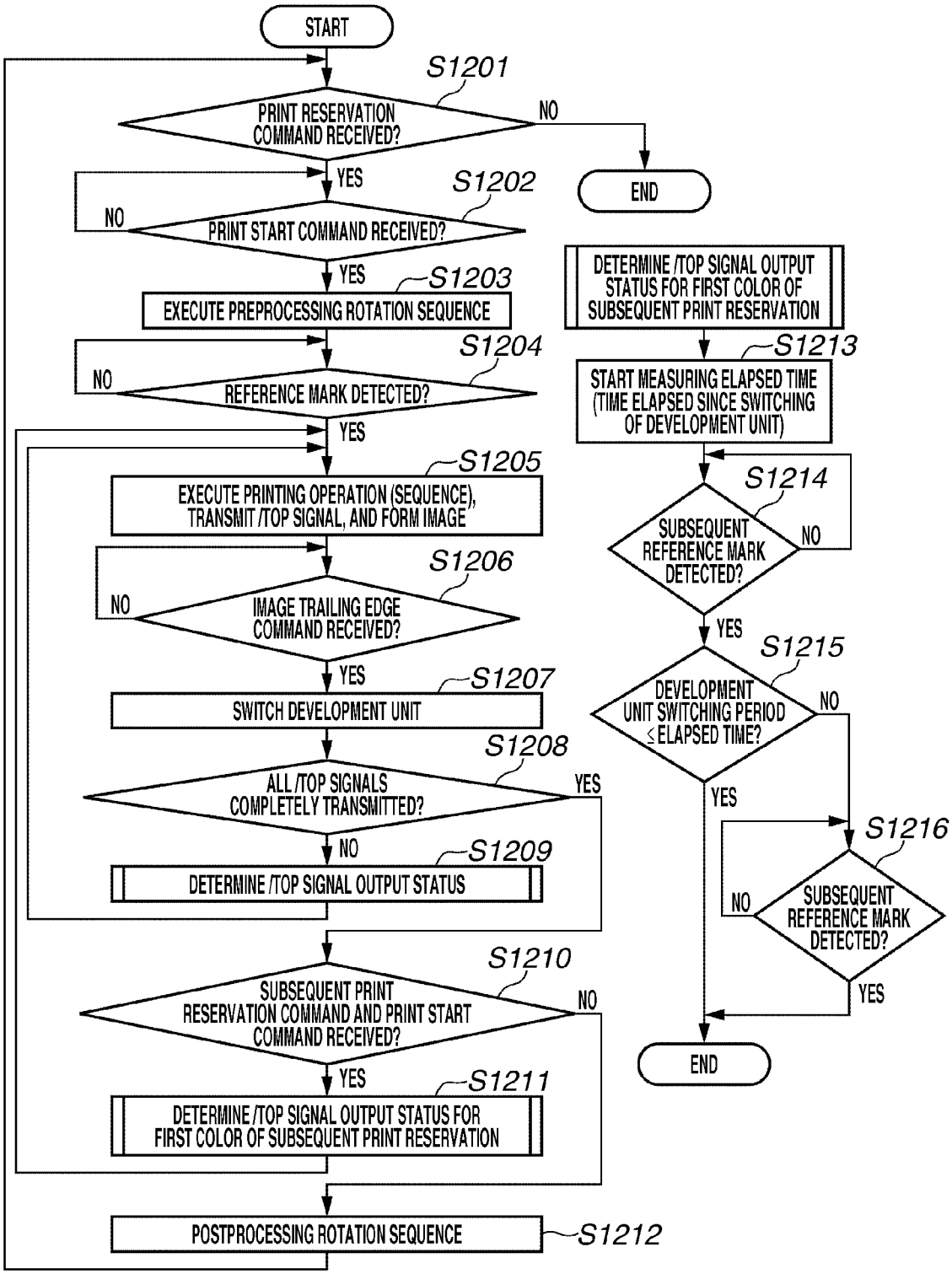
FIG. 11 is a flow chart illustrating an example of processing executed by the color image forming apparatus according to the third exemplary embodiment of the present invention.
Figure 12:
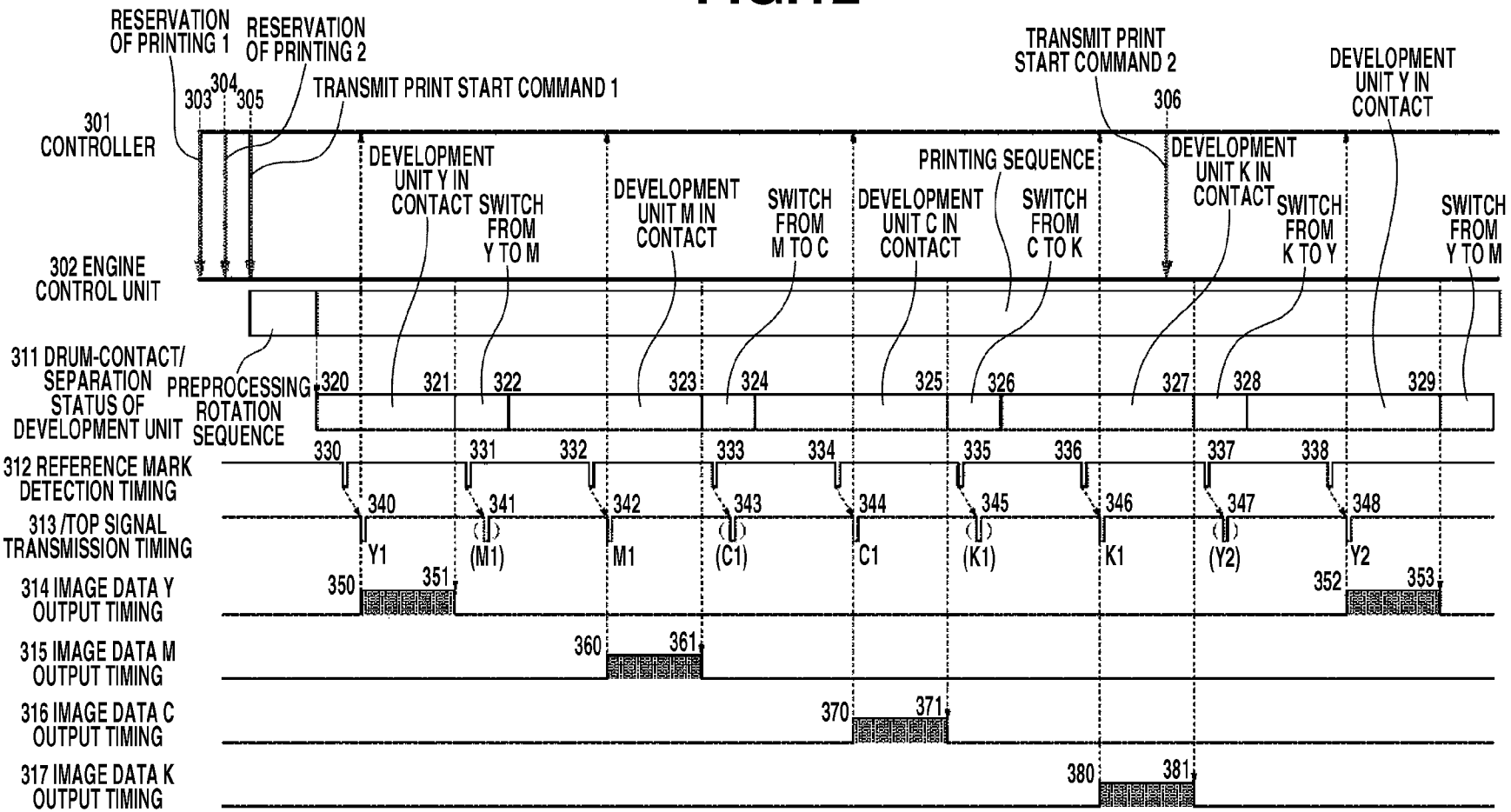
FIG. 12 is a timing chart illustrating timing of image forming executed by a color image forming apparatus according to a conventional method.

FIG. 11 is a flow chart illustrating an exemplary flow of a print operation according to the present exemplary embodiment. The print operation illustrated in FIG. 11 is basically similar to that described above with reference to the flow chart of FIG. 6 in the first exemplary embodiment. Therefore, the similar operations are not repeatedly described here and only difference points will be described in detail below. More specifically, the difference from the print operation illustrated in FIG. 6 is that the engine control unit 202 receives an image trailing edge command after receiving a video signal as described above.

In the example illustrated in FIG. 6, in step S701, the engine control unit 202 receives a print reservation command and image location information. On the other hand, in the example illustrated in FIG. 11, in step S1201, the engine control unit 202 receives a print reservation command but does not receive an image trailing edge command.

Furthermore, in step S706 of FIG. 6, the engine control unit 202 calculates the development unit contact time. On the other hand, in the example illustrated in FIG. 11, in step S1206, the engine control unit 202 receives an image trailing edge command. Accordingly, in the present exemplary embodiment, it is not necessary for the engine control unit 202 to calculate a development unit contact time.

As described above, in the present exemplary embodiment, the engine control unit 202 receives an image trailing edge command from the controller unit 201. Accordingly, it is not necessary for the engine control unit 202 to calculate the timing to switch the development unit. Therefore, the engine control unit 202 can start the switching of the development unit when the image forming trailing edge command is received.

The above-described exemplary embodiment of the present invention can be variously modified according to the effects of the present invention. Furthermore, a modification of the above-described exemplary embodiment of the present invention is included in the scope of the present invention.

In the above-described first through the third exemplary embodiments of the present invention, the trailing edge of an image area is used as the reference for calculating the timing to switch the development unit. However, the present exemplary embodiment is not limited to this. More specifically, the size of the transfer material 2 may also be used as the reference instead.

In this case, the periphery of the intermediate transfer member 9 and the size of the transfer material 2 are compared. As a result of the comparison, if the switching of the development unit can always and securely be switched in the area of the intermediate transfer member 9 on which no image is formed, it is also useful to determine that the development unit can be switched regardless of the trailing edge of an image area.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-076769 filed Mar. 26, 2009 and No. 2009-283463 filed Dec. 14, 2009, which are hereby incorporated by reference herein in their entirety.

What is claimed is:

1. An image forming apparatus comprising:

an image bearing member;

a plurality of development units configured to form an image on the image bearing member;

a development rotary configured to serially switch each of the plurality of development units to an image forming position at which an image is formed on the image bearing member;

an intermediate transfer member on which the image formed on the image bearing member is transferred; and a control unit configured to give an instruction to start forming of the image if a mark that is a reference of starting the forming of the image and is provided on the intermediate transfer member, is detected, wherein the control unit is configured to compare a first time period, which is a time from start of switching of the development unit to detection of the mark, with a second time period, which is a time taken for switching the development unit, and if the second time period is shorter than the first time period, configured to start switching to a subsequent development unit by moving the subsequent development unit to the image forming position after the image is completely formed by the development unit existing at the image forming position.

2. The image forming apparatus according to claim 1, wherein the control unit is configured, if the second time period is longer than the first time period, to calculate a third time period, which is a time period from when the mark is detected, to when image forming is started by a subsequent development unit, and if the second time period is shorter than a total of the first time period and the third time period, configured to form an image by a subsequent development unit without idling the intermediate transfer member, while if the second time period is longer than a total of the first time period and the third time period, configured to execute control for forming the image by the subsequent development unit after idling the intermediate transfer member by one rotation.

3. The image forming apparatus according to claim 1, wherein the control unit is configured, in forming images of a plurality of color images, to control the start of switching of the development unit by receiving image information of the color images and by calculating a period of time taken for forming an image in each development unit corresponding to each color based on the received image information, according to the calculated time period for forming an image in each development unit.

4. An image forming apparatus comprising:

an image bearing member;

a plurality of development units configured to form an image on the image bearing member;

a development rotary configured to serially switch each of the plurality of development units to an image forming position at which an image is formed on the image bearing member;

an intermediate transfer member on which the image formed on the image bearing member is transferred; and a mark that is provided on the intermediate transfer member and is a reference of starting forming of the image;

a control unit configured to give an instruction to start forming of the image if the mark is detected, wherein the control unit is configured to execute control for starting moving of a subsequent development unit to the image forming position so that the moving of the subsequent development unit to the image forming position is completed before image forming on the image bearing member by the subsequent development unit is started when the mark on the intermediate transfer member is detected.

5. The image forming apparatus according to claim 4, wherein the control unit is configured to compare a second time period, which is a period of time taken for switching the development unit, and a fourth time period, which is calculated based on timing to start switching of the development unit and timing to start image forming by a subsequent development unit, and wherein the control unit is configured, if the second time period is shorter than the fourth time period, to form an image by the subsequent development unit without idling the intermediate transfer member, while if the second time period is longer than the fourth time period, configured to execute control for forming the image by the subsequent development unit after idling the intermediate transfer member by one rotation.

6. The image forming apparatus according to claim 4, wherein the control unit is configured, in forming images of a plurality of color images, to control the start of switching of the development unit by receiving image information of the color images and by calculating a period of time taken for forming an image in each development unit corresponding to each color based on the received image information, according to the calculated time period for forming the image in each development unit and the timing to start the image forming in the subsequent development unit.

7. An image forming apparatus comprising:

an image bearing member;

a plurality of development units configured to form an image on the image bearing member;

a development rotary configured to serially switch each of the plurality of development units to an image forming position at which an image is formed on the image bearing member;

an intermediate transfer member on which the image formed on the image bearing member is transferred; and a control unit configured to give an instruction to start forming of the image if a mark that is a reference of starting forming of the image and is provided on the intermediate transfer member, is detected, wherein the control unit is configured, if a length of the formed image is shorter than a first threshold value, to execute control for starting switching of the subsequent development unit to the image forming position.

8. The image forming apparatus according to claim 7, wherein the control unit is configured, by comparing a total length of a longitudinal dimension of the intermediate transfer member from the formed image to the mark and a leading edge margin of the image to be subsequently formed, with a second threshold value when the length of the formed image is longer than the first threshold value, to execute control for starting the image forming by the subsequent development unit without idling the intermediate transfer member if the total length is longer than the second threshold value, while the control unit is configured, if the total length is shorter than the second threshold value, to execute control for forming by the subsequent development unit after idling the intermediate transfer member by one rotation.

* * * * *